US011725257B2

(12) United States Patent
Rossini et al.

(10) Patent No.: US 11,725,257 B2
(45) Date of Patent: Aug. 15, 2023

(54) GOLD ALLOY WITH COLOR COMPATIBLE WITH THE 5N STANDARD AND METHOD OF PRODUCTION THEREOF

(71) Applicant: ARGOR-HERAEUS SA, Mendrisio (CH)

(72) Inventors: Marta Rossini, Melide (CH); Sergio Arnaboldi, Suello (IT); Marco Nauer, Morbio Inferiore (CH)

(73) Assignee: Argor-Heraeus SA

( * ) Notice: Subject to any disclaimer, the term of this patent is extended or adjusted under 35 U.S.C. 154(b) by 311 days.

(21) Appl. No.: 16/970,914

(22) PCT Filed: Mar. 14, 2019

(86) PCT No.: PCT/IB2019/052092
§ 371 (c)(1),
(2) Date: Aug. 18, 2020

(87) PCT Pub. No.: WO2019/175834
PCT Pub. Date: Sep. 19, 2019

(65) Prior Publication Data

US 2020/0392605 A1 Dec. 17, 2020

(30) Foreign Application Priority Data

Mar. 15, 2018 (CH) ..... 00328/18

(51) Int. Cl.

| | |
|---|---|
| ***C22C 5/02*** | (2006.01) |
| ***C22F 1/14*** | (2006.01) |
| ***A44C 27/00*** | (2006.01) |
| ***C22C 1/02*** | (2006.01) |
| ***G04B 37/22*** | (2006.01) |

(52) U.S. Cl.
CPC ..... *C22C 5/02* (2013.01); *A44C 27/003* (2013.01); *C22C 1/02* (2013.01); *C22F 1/14* (2013.01); *G04B 37/22* (2013.01)

(58) Field of Classification Search
CPC ..... C22C 5/04; C22F 1/14
See application file for complete search history.

(56) References Cited

U.S. PATENT DOCUMENTS

| | | | | |
|---|---|---|---|---|
| 6,342,182 | B1 | 1/2002 | Vincent | |
| 2015/0071814 | A1 | 3/2015 | Feinberg et al. | |
| 2015/0345001 | A1* | 12/2015 | Arnaboldi | C22F 1/14 148/508 |

FOREIGN PATENT DOCUMENTS

| | | |
|---|---|---|
| CN | 102776407 | 11/2012 |
| DE | 102004060730 | 6/2006 |
| DE | 202011102731 | 12/2011 |
| EP | 1512765 | 3/2005 |
| JP | S52139620 | 11/1977 |
| JP | S58144444 | 8/1983 |
| JP | S59118830 | 7/1984 |
| JP | H09184033 | 7/1997 |
| JP | 2005-082890 | 3/2005 |
| JP | 2005-120465 | 5/2005 |
| JP | 4058101 | 3/2008 |
| JP | 2014-530962 | 11/2014 |
| JP | 2016-505710 | 2/2016 |
| JP | 2016-536470 | 11/2016 |
| WO | WO2014087216 | 6/2014 |

OTHER PUBLICATIONS

PCT International Search Report and Written Opinion issued in International Application No. PCT/IB2019/052092 dated Jul. 2, 2019, 10 pages.
JP Office Action in Japanese Appln. No. 2020-543743, dated Feb. 7, 2023, 11 pages (with English translation).

* cited by examiner

*Primary Examiner* — Jessee R Roe
(74) *Attorney, Agent, or Firm* — Fish & Richardson P.C.

(57) ABSTRACT

A Gold alloy for jewelry, comprising:
- Gold: in the amount comprised between 780‰ and 840‰ in weight;
- Copper: in the amount comprised between 125‰ and 167‰ in weight;
- Silver: in the amount comprised between 15‰ and 54‰ in weight;
- Platinum or Palladium, wherein the content of Palladium or Platinum is such that the assembly of Gold, Copper, Silver and Platinum or Gold, Copper, Silver and Palladium reaches a percentage at least equal to 980‰, and more preferably the 1000‰ in weight of the alloy;

and wherein the so composed Gold alloy shows, under the conditions referred to in the ISO DIS 8654:2017 standard, a color compatible with the 5N alloy color standard.

21 Claims, 14 Drawing Sheets

GOLD ALLOY WITH COLOR COMPATIBLE WITH THE 5N STANDARD AND METHOD OF PRODUCTION THEREOF

CROSS-REFERENCE TO RELATED APPLICATION

This application is a National Stage Application under 35 U.S.C. § 371 and claims the benefit of International Application No. PCT/IB2019/052092, filed on Mar. 14, 2019, which claims priority to CH Application Serial No. 00328/18, filed on Mar. 15, 2018. The disclosure of the prior application is considered part of and is incorporated by reference in the disclosure of this application.

FIELD

The concepts herein refer to the field of Gold alloys and in particular relate to a Gold alloy, with color compatible to 5N standard.

The concepts herein also relate to a method of production of Gold alloys having color compatible with the 5N standard.

The Gold alloy and the method of production of Gold alloys according to the concepts herein are an alloy and a method of production of Gold alloys for jewelry and watchmaking applications respectively.

BACKGROUND ART

In the field of jewelry and watchmaking, Gold is not used in pure form, since it is too ductile. For jewelry and watchmaking applications are typically used Gold alloys for jewelry or watchmaking, characterized by a higher hardness with respect to the Gold in pure form and/or with respect to low hardness or high ductility Gold alloys.

It is known that, generally, Gold alloys can undergo over time unwanted color alterations, following interactions with aggressive environments. These interactions bring to the formation of thin layers of reaction products, which staying adherent to the alloy surface, cause an alteration of the color and of the gloss (document "Observations of onset of sulfide tarnish on Gold-base alloys"; JPD, 1971, Vol. 25, issue 6, pag. 629-637).

Environments able to promote color alterations of Gold alloys are various and are linked to their applications.

Standard colors for Gold alloys can be univocally measured in the CIELAB 1976 color space, which defines a color on the basis of a first L* parameter, a second a* parameter and a third b* parameter, wherein the first L* parameter identifies the brightness and adopts values comprised between 0 (black) e 100 (white) whereas the second a* parameter and the third b* parameter represent chromaticity parameters. In particular, in CIELAB 1976 color chart, the achromatic scale of greys is detected by points wherein a*=b*=0; positive values for the second parameter a* indicate a color tending the more to red as the higher the value of the second parameter is; negative values for the second parameter a* indicate a color tending the more to green as the value of the second parameter a* is a high absolute value, although negative; positive values for the third parameter b* indicate a color tending the more to yellow as the higher the value of the third parameter is; negative values for the third parameter b* indicate a color tending the more to blue as the value of the third parameter b* is a high absolute value, although negative.

In particular, the ISO DIS 8654:2017 standard defines seven color designations as for the jewelry Gold alloys. In particular, these alloys are defined according to the following table, wherein the color is defined on a standard reference specified between 0N and 6N.

| Color | Designation |
|---|---|
| 0N | Yellow-green |
| 1N | Dark yellow |
| 2N | Light yellow |
| 3N | Yellow |
| 4N | Pink |
| 5N | Red |
| 6N | Dark red |

For measuring the color of an alloy, in particular, the ISO DIS 8654 standard specifies that the measuring instrument for measuring the color of an alloy must comply with the CIE No. 15 publication. In particular, this measuring instrument is a spectrophotometer with integration sphere, able to measure a reflection spectrum with measurement geometry compatible with the designations of: 8° or 8°: of (included specular component). The instrument is adjusted according to the following parameters:

included specular component standard illuminating D65 at 6504 K standard observer 2°

The color measurement results from an average of 5 different measures of the sample, with repositioning, ensuring a pivoting between a measure and another.

From ISO DIS 8654:2017 standard derives the following table which shows the nominal values L*, a*, b* as trichromatic coordinates for alloys of 5N standard color, including the tolerances.

| | Trichromatic coordinates | | | | | |
|---|---|---|---|---|---|---|
| | Nominal values | | | Tolerances | | |
| Color | L* | a* | b* | L* [MAX/Min] | a* | b* |
| 5N | 87.7 | 8.32 | 18.58 | 89.4 | 9.74 | 19.55 |
| | | | | | 8.62 | 16.97 |
| | | | | 85.9 | 6.96 | 17.55 |
| | | | | | 7.89 | 20.19 |

Starting from the standard it is then possible to obtain, within the CIE L*a*b* color space, a plurality of areas each of which represents the color intervals within which it is possible to assert that an alloy shows a 0N . . . 6N color. This area related to 5N is shown in FIG. 1.

The today's precision with which it is possible to measure the quantities of components of a Gold alloy, typically with precision higher than 0.1 ppt (a part for each 10000) in weight, both before the melting of the alloy and after it (post-melting analysis) permit to identify the color with high accuracy. The ISO DIS 8654:2017 standard also proposes chemical compositions recommended for each of the 0N-6N alloys. In particular, for the 5N coloration, the recommended chemical compositions are the ones specified in the following table:

| | Chemical composition % | | |
|---|---|---|---|
| Color | Au | Ag | Cu |
| 5N | 75.0 | 4.5-5.5 | Remaining part |

The Applicant has noted that the 5N Gold alloy shows a substantial color instability, in particular when exposed to environments wherein there are chlorides or sulphides.

Variations of the color of a Gold alloy according to the color as defined on the CIE 1976 color chart and specified by the E=f (L*, a*, b*) coordinate, defined:

$L_0$* as first parameter in original conditions, at time $t_0$=0;

$a_0$* second parameter in original conditions, at time $t_0$=0;

$b_0$* as third parameter in original conditions, at time $t_0$=0;

are defined in the following equation:

$$\Delta E(L^*,a^*,b^*)=\sqrt{(L^*-L_0^*)^2+(a^*-a_0^*)^2+(b^*-b_0^*)^2}$$

It has also been noted that the human eye of a technician expert in precious materials is able to detect variations of color ΔE (L*, a*, b*)>1.

In particular, according to recent studies (WO 2014/0872216 A1) the 5N Gold alloy, exposed to vapors of Thioacetamide for 150 hours (according to the UNI EN ISO 4538:1998 standard), shows a variation of color ΔE (L*, a*, b*) equal to 5.6; when exposed to an aqueous 50 g/liter of Sodium Chloride solution (NaCl) at 35° C. for 175 hours, the 5N Gold alloy shows a variation of color ΔE (L*, a*, b*) equal to 3.6.

The 5N Gold alloy shows a color which is much appreciated in jewelry field, but its substantial instability of the color when exposed to chemically aggressive environments, makes the jewelry items using it particularly delicate and poorly adapted to an intensive use with sweating or in marine environment.

The JP2000336470 document shows Gold alloys with antimicrobial properties suitable for being deposited on common use items; it describes in particular a Gold alloy with approximately 80% of Gold weight, approximately 12% of Copper weight, and 5% of Palladium weight, which further than being antimicrobial shows a color defined as "pink Gold". The addition of even small quantities of Palladium to Gold alloys causes tangible color variations; additions of 5% in weight of Palladium cause a variation of the color of the alloy toward a significantly pale color.

The US 2017/0241003 A1 document shows a plurality of embodiments of alloys having glass matrix and composite structure, which have many phases and comprise Silicon. Silicon causes inclusions, also of relevant size; its use is then inconvenient in the applications of high jewelry. Furthermore, Silicon is known for matifying the colors of alloys; according to US 2017/0241003 A1 the presence of Silicon brings to a pale or white color. The composite structure, with many phases, also because of their fragility, does not permit to obtain surfaces having quality and color uniformity sufficient for applications of high jewelry.

EP1512765A1 discloses a plurality of specific examples of Gold alloys, each one shown in a table (table 1) with precise specific values. With the exclusion of an example where Gold is present at 917‰ in weight, the other examples relate to alloys wherein Gold is, in weight, equal to 750‰, 750.5‰, 760‰, 770‰. The specific examples of table 1 EP1512765A1 show also precise values of the amount of Copper, anyway comprised between 210‰ and 244.5‰, with the exclusion of the example wherein Gold is present at 917‰ in weight, where Copper is at 83‰. Platinum or Palladium, if present, are disclosed in percentage equal to 20‰ or 30‰ (Platinum), and 20‰ or 40‰ (Palladium). The alloy is conceived for offering strength to the variation of color when exposed to tap, sea, pool, salted or soapy waters. The Gold alloys claimed in EP1512765 document are pink Gold alloys, in particular their colors are out of the 5N color range according to ISO standard.

According to the tests done by the Applicant, for example, an alloy with Gold in the amount equal to 768‰ in weight, Copper in the amount equal to 218‰ in weight and Palladium in the amount equal to 14‰ in weight shows a color well outside of the ISO 8654:2017 standard range for 5N alloys, and that in particular, shows the following coordinates: L* 84.93 a* 8.78 b* 13.82. Since it has been observed that Palladium changes the color of the alloys making them paler as its amount in weight increases, alloys for example with Palladium higher than 20‰ in weight and Gold lower than 800‰ in weight do not have colors that fall in the range of the ISO 8654:2017 standard for 5N alloys.

DE 20 2011 102 731 discloses a Gold alloy conceived for keeping over time its color. The DE 20 2011 102 731 document refers in its turn to the known art according to EP1512765A1. In paragraph [0007] is disclosed a Gold alloy at 75‰ in weight, which comprises between 0.5‰ and 13‰ in weight of Silver, between 0.5‰ and 5‰ in weight of Platinum, between 0.5‰ and 5‰ in weight of Palladium and the remaining part in Copper.

The concepts herein describe a Gold alloy that shows a color compatible to the 5N one and that is resistant to the discoloration and/or tarnishing with performances greater than the 5N alloy according to the compositions suggested by the ISO reference standard. It is in particular the concepts herein encompass a Gold alloy for jewelry or watchmaking that shows a color corresponding to the 5N one according to ISO standard.

SUMMARY

These and other purposes are obtained by the alloy and by the method of production thereof described in the following aspects. The aspects can be combined among them or with portions of the following detailed description; the here described aspect dependencies are to be intended as preferred and non-limiting.

A first aspect of the concepts herein a Gold alloy for jewelry, comprises:

Gold: in the amount equal to 780‰, more preferably 790‰, and 840‰ in weight;

Copper: in the amount comprised between 125‰ and 167‰ in weight;

Silver: in the amount comprised between 15‰ and 54‰ in weight;

Platinum or Palladium, wherein the content of Platinum or Palladium is such that the assembly Gold, Copper, Silver and Platinum or Gold, Copper, Silver and Palladium reaches a percentage, or amount, at least equal to 980‰, and more preferably the 1000‰ in weight of the alloy;

and wherein the so composed Gold alloy shows, under the conditions referred to in the ISO DIS 8654:2017 standard, a color compatible with the standard of color of the 5N alloys.

According to a second non-limiting aspect, said alloy is characterized in that it comprises Palladium in the amount comprised between 4‰ and 17‰.

More in particular, according to a third non-limiting aspect depending on the second aspect, said alloy is characterized in that it comprises Palladium in the amount comprised between 5‰ and 15‰.

According to a fourth non-limiting aspect, depending on one or more of the preceding aspects, said Gold alloy comprises Gold in the amount comprised between 790‰ and 800‰, Copper in the amount comprised between 154‰ and 167‰ in combination with Silver in the amount comprised between 23‰ and 37‰ and Palladium in the amount comprised between 9‰ and 11‰, more preferably in the amount substantially equal to 10‰.

Alternatively, according to a fifth non-limiting aspect, depending on one or more of the preceding first to third aspects, said Gold alloy comprises Gold in the amount comprised between 790‰ and 800‰, Copper in the amount comprised between 154‰ and 167‰ in combination with Silver in the amount comprised between 23‰ and 37‰ and Platinum in the amount comprised between 4‰ and 6‰, preferably in the amount substantially equal to 5‰.

According to a sixth non-limiting aspect, depending on one or more of the preceding aspects, for withstanding the color variation and/or tarnishing and undergoing in an environment containing Thioacetamide, in particular in an environment containing Thioacetamide according to the UNI EN ISO 4538:1998 standard, the alloy has a color variation ΔE (L*, a*, b*) within the 24 h lower than 3.5, more preferably lower than 3.2 and even more preferably lower than 3.

According to a seventh non-limiting aspect, depending on one or more of the preceding first to third aspects and on the sixth aspect, the Silver is contained in the amount comprised between 15‰ and 37‰, optionally between 15‰ and 35‰.

According to an eighth non-limiting aspect, depending on one or more of the preceding aspects, the alloy is a quaternary Iron-free alloy, and optionally free from Platinum and Iron.

According to a ninth non-limiting aspect, depending on one or more of the preceding first to third or sixth aspects, said alloy is an alloy that comprises Gold in the amount comprised between 790‰ and 792‰, Copper in the amount comprised between 165‰ and 170‰, more preferably 167‰, Silver in the amount comprised between 32‰ and 40‰, Platinum between 4‰ and 6‰ and characterized in that it is free from Iron and/or Palladium.

According to a tenth non-limiting aspect depending on one or more of the preceding first to third or sixth aspects, said Gold alloy is an alloy within which the Gold is present in the amount comprised between 810‰-835‰ and within which the Copper is present in the amount comprised between 128‰ and 154‰ optionally between 129‰ and 153‰, in combination with Silver in the amount comprised between 18‰ and 35‰ and Palladium in the amount comprised between 5‰ and 15‰, within which in this alloy the color variation ΔE (L*, a*, b*) within 24 h in said environment containing Thioacetamide according to the UNI EN ISO 4538:1998 standard is lower than 3.8.

According to an eleventh non-limiting aspect, depending on one or more of the preceding first to third or sixth aspects, and on said tenth aspect, said alloy comprises Gold in the amount comprised between 831‰ and 834‰, and in particular substantially equal to 833‰, Palladium in the amount comprised between 4‰ and 6‰, more preferably in the amount substantially equal to 5‰, Copper in the amount comprised between 142‰ and 146‰ and Silver in the amount comprised between 12‰ and 22‰.

According to an eleventh non-limiting aspect, depending on one or more of the preceding first to third or sixth aspects, and on the previous tenth aspect, said alloy comprises Gold in the amount comprised between 831‰ and 834‰, and in particular substantially equal to 833‰, Palladium in the amount comprised in the range between 14‰ and 17‰, more preferably 16‰, Copper substantially comprised in the range between 127‰ and 131‰ and Silver substantially comprised in the range between 19‰ and 25‰.

According to a thirteenth non-limiting aspect, depending on one or more of the preceding aspects, said alloy is a homogeneous Gold alloy, free from second phases and in particular free from carbides and/or oxides.

According to the concepts herein, as "free from secondary phases" or "free from second phases" is intended an alloy free from elements that can generate said second phases, in particular in a proceeding of melting and subsequent solidification without other thermal treatments; second phases that create in the liquid phase and remain downstream of the alloy solidification, are harmful second phases, for example carbides and/or oxides that during the polishing step are visible at naked eye on the surface of the polished item, and that then prevent to obtain items of high surface quality, compatible with the needs required in the high jewelery field. It is possible to expose the alloy to thermal treatment processes, able to give it a hardening, so that due to precipitation subtle precipitates can be present, as results of said thermal treatment; in this case these are precipitates that prevent from the movement of displacement by increasing the mechanical properties in the material, and contrasting the incidence of deformations in the items realized with the present alloys.

According to a fourteenth non-limiting aspect, depending on one or more of the preceding aspects, said alloy is a Gold alloy free from chemical elements susceptible to cause the generation of carbides and/or oxides.

According to a fifteenth non-limiting aspect, depending on one or more of the preceding thirteenth or fourteenth aspects, said Gold alloy is characterized by the absence of—or equivalently free from—Vanadium, Magnesium, Indium, Silicon, Tin, Titanium, Tungsten, Molybdenum, Niobium, Tantalum, Zirconium, Yttrium, Rhenium, Germanium.

In particular, according to a sixteenth non-limiting aspect, the Gold alloy is an alloy free from Silicon and/or is a quaternary or quinary alloy.

According to a seventeenth non-limiting aspect, the Gold alloy is a crystalline alloy, optionally 100‰ crystalline.

According to an eighteenth non-limiting aspect, depending on one or more of the preceding aspects, said alloy is free from Nickel, Cobalt, Arsenic and Cadmium.

According to a nineteenth non-limiting aspect, depending on one or more of the preceding aspects, the color assumed by said Gold alloy complies with the limits given by the ISO DIS 8564:2017 standard for 5N alloys even after the exposition to air for a time at least equal to 840 hours.

According to a twentieth non-limiting aspect depending on one or more of the preceding first to third and/or thirteenth to nineteenth aspects, said Gold alloy is a Gold alloy comprising Gold in the amount comprised between 790‰ and 800‰, Palladium in the amount comprised between 4‰ and 17‰, more preferably between 4‰ and 16‰ and even more preferably comprised between 5‰ and 15‰, and Silver comprised between 35‰ and 40‰, within which the Copper is comprised between 157‰ and 160‰ and more preferably is substantially equal to 158‰ and wherein there is Iron in the amount comprised between 3‰ and 7‰.

According to a twenty-first aspect, the concepts herein encompass a method for the production of a Gold alloy, said method being characterized in that it comprises:

a) a step (hereinafter defined as homogenization) wherein all the pure elements constituting the alloy are melted in such a way as to obtain an homogeneous mixture; this mixture comprises:

Gold: in the amount comprised between 780‰, more preferably 790‰, and 840‰ in weight;

Copper: in the amount comprised between 125‰ and 167‰ in weight;

Silver: in the amount comprised between 15‰ and 54‰ in weight;

Platinum or Palladium, wherein the content of Platinum or Palladium is such that the assembly Gold, Copper, Silver and Platinum or Gold, Copper, Silver and Palladium reaches a percentage at least equal to 980‰, and more preferably the 1000‰ in weight of the alloy, b) a step of introduction of the mixture in a melting pot, and a subsequent melting through heating until melting.

According to a twenty-second non-limiting aspect, depending on said twenty-first aspect, said melting is a continuous or discontinuous melting, comprising a casting step wherein the melted material is casted in a die realized in graphite or in a bracket in graphite and wherein said mixture is a mixture of materials with properties chemically without affinity to surfaces in graphite.

According to a twenty-third non-limiting aspect, depending on previous twenty-first or twenty-second aspect, said melting is a continuous melting, wherein the melted material is casted in a die realized in graphite and wherein said mixture is a mixture of materials with anti-gripping properties on surfaces in graphite, in particular at least free from Vanadium.

According to a twenty-fourth non-limiting aspect, depending on one or more of the aspects from twenty-first to twenty-third, after the continuous or discontinuous melting said alloy is subject to a cooling step followed by one or more hot or cold plastic deformation step and one or more thermal treatments.

According to a twenty-fifth non-limiting aspect, depending on one or more of the preceding twenty-first to twenty-fourth aspects, during said melting, the melting pot is subject to a gas controlled atmosphere and in particular is subject, at least temporarily, to an vacuum condition.

According to a twenty-sixth non-limiting aspect, depending on one or more of the preceding twenty-second to twenty-fifth aspects, during said continuous casting step, said pot is subject to a controlled atmosphere, to a pressure equal or lower than the environmental pressure, and said gas is an inert gas, preferably argon, or a reducing, preferably forming gas.

According to a twenty-seventh non-limiting aspect, depending on one or more of the preceding twenty-second to twenty-sixth aspects, during said discontinuous casting step, said pot is subject to a controlled atmosphere lower than 800 mbar, preferably lower than 700 mbar, and said gas is an inert gas, preferably argon.

According to a twenty-eight aspect, the concepts herein encompass an item of jewelry, comprising a Gold alloy in accordance to one or more of the preceding aspects concerning said Gold alloy.

The characteristics of the aspects concerning the here described Gold alloy and/or according to the following detailed description can be conveniently applied also in combination with the method according to the twenty-first aspect.

According to another non-limiting aspect, or twenty-ninth aspect, depending on the previous aspect, said item of jewelry comprises a jewel or a watch or a watch bracelet or a movement or part of a mechanical movement for watches.

According to another non-limiting aspect, or thirtieth aspect, depending on the previous aspect, said watch or mechanical movement for watches are configured for being worn or installed in wristwatches respectively.

According to a thirty-first aspect, the concepts herein encompass a Gold alloy for jewelry, comprising:

Gold: in the amount comprised between 780‰, more preferably 790‰, and 900‰ in weight;

Copper: in the amount comprised between 85‰ and 170‰ in weight;

Palladium, in the amount comprised between 4‰ and 17‰ in weight;

wherein the sum of the amounts of Gold and Copper is at least equal to 958‰ in weight and wherein the so composed Gold alloy shows, under the conditions referred to in the ISO DIS 8654:2017 standard, a color compatible with the 5N alloy color standard.

According to another non-limiting aspect, or thirty-second aspect, depending on the preceding thirty-first aspect, the sum of the amounts of Gold, Copper and Palladium is at least equal to 963‰ in weight.

According to another non-limiting aspect, or thirty-third aspect, depending on the preceding thirty-second aspect, the sum of the amounts of Gold, Copper and Palladium is at least equal to 980‰ in weight and Palladium is comprised in the amount comprised between 8‰, more preferably 10‰, and 17‰, more preferably 15‰ in weight.

According to another non-limiting aspect, or thirty-fourth aspect, depending on the preceding thirty-first or thirty-second aspect, the alloy is a ternary alloy, wherein Gold is contained in the amount comprised between 873‰ and 902‰ in weight.

According to another non-limiting aspect, or thirty-fifth aspect, depending on the preceding thirty-fourth aspect, the Gold is contained in the amount comprised between 875‰ and 900‰.

According to another non-limiting aspect, or thirty-sixth aspect, depending on one or more of the preceding thirty-first to thirty-fifth aspects, the sum of the amounts of Gold, Copper and Palladium is substantially equal to 1000‰.

According to another non-limiting aspect, or thirty-seventh aspect, depending on one or more of the preceding thirty-first to thirty-third aspects, the alloy is a quaternary alloy comprising indium in the amount comprised between 13‰ and 22‰ in weight.

According to another non-limiting aspect, or thirty-eighth aspect, depending on the preceding thirty-fourth aspect, the alloy is a quaternary alloy comprising indium in the amount comprised between 15‰ and 20‰.

According to another non-limiting aspect, or thirty-ninth aspect, depending on the preceding thirty-seventh and/or thirty-eight aspect, the alloy has a color variation $\Delta E$ (L*, a*, b*) within the 24 h in an environment containing Thioacetamide according to the UNI EN ISO 4538:1998 standard lower than 3.5.

According to another non-limiting aspect, or fortieth aspect, depending on one or more of the preceding thirty-seventh to thirty-ninth aspects, the alloy has a color variation $\Delta E$ (L*, a*, b*) within the 70 h in a 50 g/L NaCl solution, thermostated at 35° C. lower than 2.4 and more preferably lower than 2.3.

According to another non-limiting aspect, or forty-first aspect, depending on one or more of the preceding thirty-seventh to fortieth aspects, the alloy has a color variation $\Delta E$ (L*, a*, b*) within the 24 h in a 50 g/L NaCl solution, thermostated at 35° C. lower than 1.75 and more preferably lower than 1.5.

According to another non-limiting aspect, or forty-second aspect, depending on the preceding thirty-first or thirty-third aspect, the alloy comprises Gold in the amount comprised between 790‰ and 793‰ in weight and Silver in the amount higher or equal to 32‰ in weight.

According to another non-limiting aspect, or forty-third aspect, depending on the preceding thirty-first to thirty-second aspects, and/or on the forty-second aspect, the alloy comprises Platinum in the amount higher or equal to 4‰ in weight and Copper in the amount higher than 165‰ in weight.

According to another non-limiting aspect, or forty-fourth aspect, depending on one or more of the preceding thirty-fourth to thirty-sixth aspects, the alloy has a color variation ΔE (L*, a*, b*) within the 24 h in an environment containing Thioacetamide according to the UNI EN ISO 4538:1998 standard lower than 3 optionally lower than 2.7.

According to another non-limiting and forty-fifth aspect, it is described the use of the Gold alloy of the present disclosure for the realization of jewels and/or watches, in particular wrist watches or pocket watches.

DESCRIPTION OF DRAWINGS

The concepts herein are hereinafter described in preferred and non-limiting embodiments, whose description is associated to the attached figures wherein.

DETAILED DESCRIPTION

Figure 1:
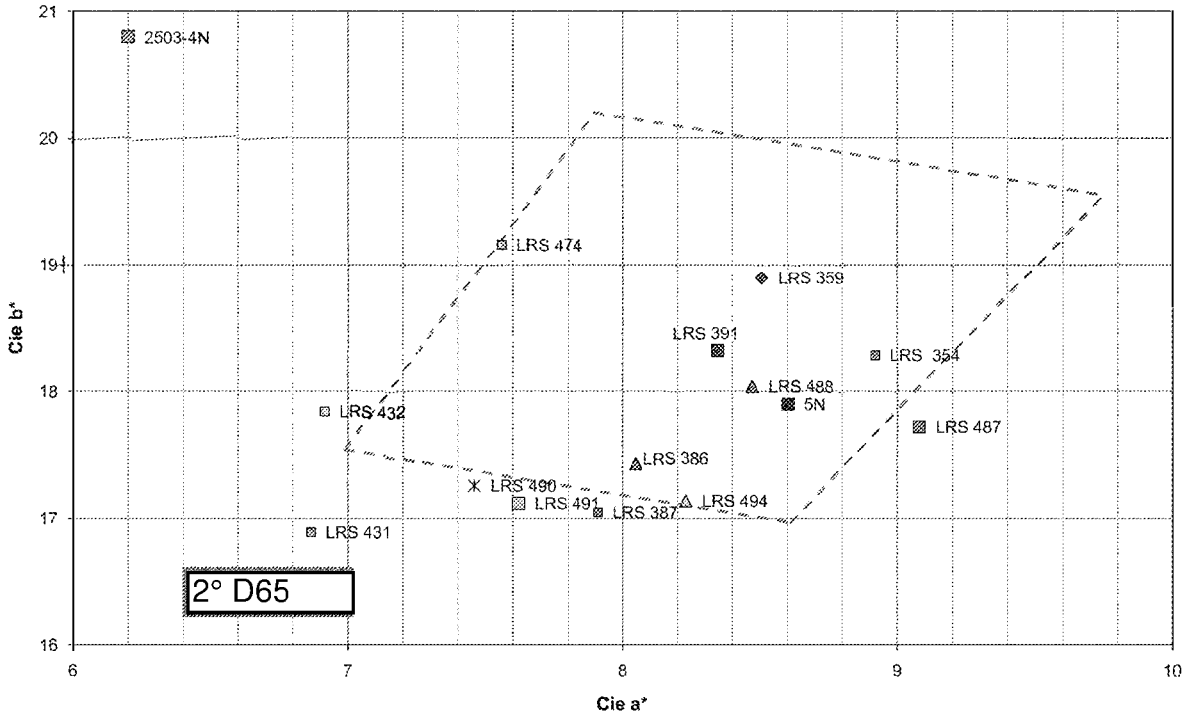
FIG. 1 shows a portion of CIELAB 1976 color space according to the coordinates L*, a*, b* wherein it has been detected an area corresponding to color intervals or tolerances admissible for Gold alloys according to the 5N ISO DIS 8654:2017 standard and wherein it is shown the typical color position for alloys embodying the concepts herein.

The concepts herein encompass a family of Gold alloys, in particular for jewelry, with tarnishing resistance property and having color compatible with the 5N ISO DIS 8654:2017 standard.

The alloys that are described in the concepts herein have been tested in terms of resistance to color variation (tarnishing) in environments containing sulphides or chlorides. In the present description, each reference to tests carried out in an environment comprising Thioacetamide is done according to the indications of the UNI EN ISO4538:1998 standard.

In order to carry out the tests, according to the concepts herein, the samples have been exposed to vapors of Thioacetamide $CH_3CSNH_2$ in an atmosphere with relative humidity of 75‰ kept through the presence of a saturated solution of trihydrate Sodium Acetate $CH_3COONa.3H_2O$ in a test chamber whose capacity must be comprised between 2 and 20 litres and wherein all the materials used for the construction of the chamber itself must be resistant to volatile sulphides and must not generate gas or vapor that can influence the results of the test.

With regard to the assessment of the resistance to corrosion and color variation in environments characterized by the presence of Sodium Chloride solutions, the tests have been carried out by immersing the samples of a Gold alloy in a 50 g/L NaCl solution, thermostated at 35° C.

In order to obtain tarnishing resistance properties, in particular in environments comprising solutions of Thioacetamide and NaCl according to the above described rules and also to obtain a Gold alloy whose color, measured according to the ISO DIS 8654:2017 standard is contained in the color interval considered as compatible with the 5N formulation, the applicant has conceived a family of Gold alloys comprising:

Gold: in the amount comprised between 780‰, more preferably 790‰, and 840‰ in weight;

Copper: in the amount comprised between 125‰ and 167‰ in weight;

Silver: in the amount comprised between 15‰ and 54‰ in weight;

Platinum or Palladium, wherein the content of Platinum or Palladium is such that the assembly Gold, Copper, Silver and Platinum or Gold, Copper, Silver and Palladium reaches a percentage at least equal to 980‰, and more preferably the 1000‰ in weight of the alloy.

According to the concepts herein, with "tarnishing" is intended a surface corrosion of the Gold alloy that causes a variation in the alloy color.

The family of Gold alloys embodying the concepts herein comprises at least quaternary alloys, and more in particular quaternary or quinary alloys. Therefore, the number of elements that are included in the not negligible amount in the family of Gold alloys embodying the concepts herein are at least equal to 4 and, preferably, not higher than 5. The limitation to quaternary or quinary alloys permits to reduce the risk of having dissimilar behaviours among the claimed alloys due to interaction among elements present in even minimal quantities.

The applicant has carried out various experiments for assessing the resistance to tarnishing and the so obtained color of the alloys, and in particular has carried out experiments on the specific embodiments indicated in the following table:

TABLE 1

| Alloy | Au ‰ wt | Cu ‰ wt | Ag ‰ wt | Fe ‰ wt | Pd ‰ wt | Pt ‰ Wt | In ‰ wt |
|---|---|---|---|---|---|---|---|
| LRS 354 | 833 | 144 | 18 | | 5 | | |
| LRS 359 | 812 | 153 | 30 | | 5 | | |
| LRS 386 | 791 | 164 | 35 | | 10 | | |
| LRS 387 | 833 | 129 | 23 | | 15 | | |
| LRS 391 | 791 | 167 | 37 | | | 5 | |
| LRS 431 | 791 | 159 | 35 | 5 | 10 | | |
| LRS 432 | 791 | 159 | 40 | 5 | 5 | | |
| LRS 474 | 791 | 154 | 51 | | 4 | | |
| LRS 487 | 875 | 115 | | | 10 | | |
| LRS 488 | 900 | 85 | | | 15 | | |
| LRS 494 | 791 | 167 | 32 | | 5 | 5 | |
| LRS 490 | 800 | 170 | | | 10 | | 20 |
| LRS 491 | 833 | 137 | | | 15 | | 15 |
| 5N ISO | 750 | 205 | 45 | | | | |

In the above indicated table it is also present a specific formulation of a Gold alloy according to the 5N ISO DIS 8654:2017 standard. This formulation uses in particular the minimum reference value as for the recommended content of Silver.

The embodiments indicated in the above table are specific non-limiting embodiments that substantially relate to two families of alloys defined according to the Gold title: a first family is constituted by alloys with concentration or amount of Gold comprised between 780‰ more preferably 790‰ and 800‰ and a second family is constituted by alloys whose concentration in Gold is comprised between 800‰, preferably between 810‰ and 840‰.

Generally, the applicant has observed that the Gold alloys for jewelry of the first family whose concentration of Gold is comprised between 780‰, more preferably 790‰ and 800‰, with concentrations of Palladium in the amount comprised between 4‰ and 17‰, more preferably between 4‰ and 16‰ and even more preferably between 5‰ and 15‰ are characterized by a behavior that, in terms of tarnishing, both in air and in Thioacetamide and in solutions of NaCl, is better than the one assumed by the 5N ISO alloy in the formulation used as reference sample.

In particular, the applicant has observed that with Gold comprised between 790‰ and 800‰, the resistance to tarnishing in air, in Thioacetamide and in solutions of NaCl, along with the color compatibility with respect to the 5N alloy are optimized for compositions wherein Silver is contained in the amount comprised between 15‰ and 37‰, more preferably between 15‰ and 35‰ and even more for alloys wherein Silver is contained in the amount comprised between 18‰ and 35‰.

The absence of Iron has permitted to obtain, for the required composition, a color compatible with the 5N ISO standard.

More in particular, in the first family of Gold alloys for jewelry with content of Gold in the amount comprised between 780‰, more preferably 790‰ and 800‰, Copper is present in the amount comprised between 154‰ and 167‰ in combination with Silver in the amount comprised between 23‰ and 37‰ and Palladium in the amount comprised between 9‰ and 11‰, more preferably in the amount substantially equal to 10‰.

Alternatively, in the first family of Gold alloys for jewelry with content of Gold in the amount comprised between 780‰, more preferably 790‰ and 800‰, Copper is present in the amount comprised between 154‰ and 167‰ in combination with Silver in the amount comprised between 23‰ and 37‰ and Platinum in the amount comprised between 4‰ and 6‰, and optionally substantially equal to 5‰.

Figure 2:
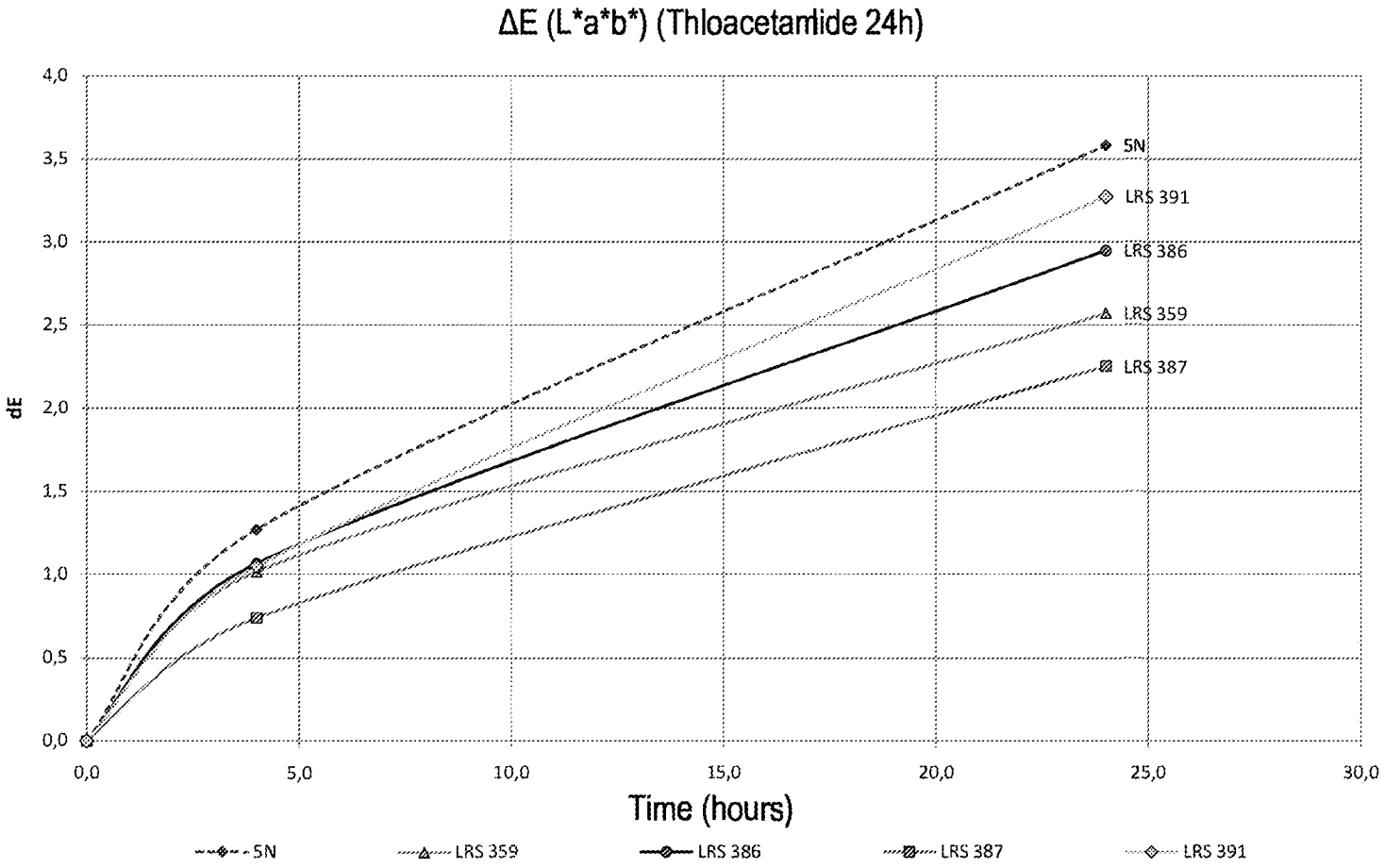
FIG. 2 shows a color variation chart according to the time of exposure to Thioacetamide in accordance to the UNI EN ISO 4538:1998 for part of the alloys embodying the concepts herein (LRS 359, LRS 391, LRS 386, LRS 387), in relation to the color variation assumed by the 5N alloy according to the ISO composition used as reference sample.
Figure 3:
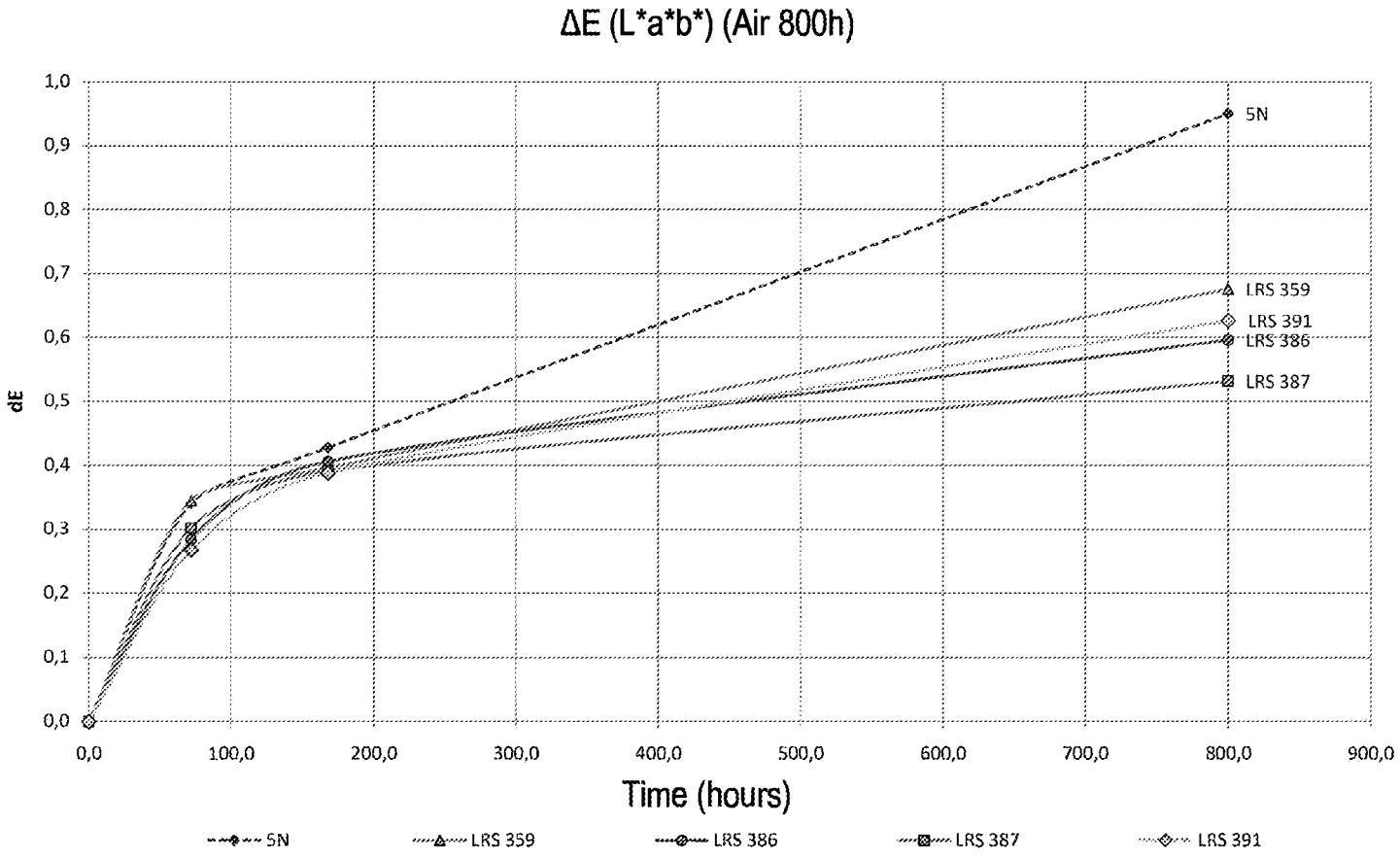
FIG. 3 shows a color variation chart according to the time of exposure to air for part of the alloys embodying the concepts herein (LRS 359, LRS 391, LRS 386, LRS 387), in relation to the color variation assumed by the 5N alloy according to the ISO composition used as reference sample.

As it is possible to observe from the chart of FIG. 2, that shows the behaviour of LRS 359, 386, 387 and 391 alloys in exposure to environments with Thioacetamide, the presence of Palladium, specifically in the amount comprised between 4‰ and 17‰, more preferably between 4‰ and 16‰ and even more preferably between 5‰ and 15‰ concurs to optimize the behaviour of the Gold alloy, because the color variation ΔE (L*, a*, b*) at 24 hours is sensitively lower than the color variation ΔE (L*, a*, b*) at 24 hours endured by the 5N alloy according to the standard formulation recommended by the ISO DIS 8654:2017 5N standard, and in particular by the 5N composition used as reference sample. From these tests it was found that in particular in an environment containing Thioacetamide, according to the UNI EN ISO 4538:1998 standard, a color variation ΔE (L*, a*, b*) within the 24 h lower than 3.5, more preferably lower than 3.3 and even more preferably lower than 3, when the 5N alloy shows—under the same conditions—a color variation substantially equal to if not lower than 3.5.

The second family, in particular, is a family of Gold alloys for jewelry whose concentration of Gold is comprised between 810‰-835‰ and wherein the Copper is present in the amount comprised between 128‰ and 154‰, more precisely between 129‰ and 153‰, in combination with Silver in the amount comprised between 18‰ and 35‰ and Palladium in the amount comprised between 5‰ and 15‰, and wherein the color variation ΔE (L*, a*, b*) within 24 h in said environment containing Thioacetamide according to the UNI EN ISO 4538:1998 standard is lower than 2.75. This second family refers to quaternary Gold alloys whose content is more preferably contained in the amount comprised between 812‰ and 833‰. This second family shows a behaviour, specifically in Thioacetamide, more improved with respect to other alloys of the concepts herein.

From the tests done on the above mentioned formulations, it has been in particular observed that the replacement of Palladium with Platinum, causes (LRS 391 alloy) a significant worsening of the performances in terms of color variation ΔE(L*,a*,b*) at 24 hours in environments with Thioacetamide with respect to the other formulations of the first or second family that use Palladium in the amount comprised between 4‰ and 17‰, more preferably between 4‰ and 16‰. However, the behaviour of the so obtained alloy is anyway better with respect to the one of the reference sample according to 5N ISO standard.

The applicant has observed that the behavior of the LRS 391 alloy is substantially the same for an subfamily of Gold alloys of composition substantially similar to the one of the LRS 391; this subfamily, in particular, is characterized in that it contains Gold in the amount comprised between 790‰ and 792‰, Copper in the amount comprised between 165‰ and 170‰, Silver in the amount comprised between 32‰ and 40‰, Platinum between 4‰ and 6‰ and characterized in that it is free from Iron and/or Palladium.

More in details, this subfamily is an subfamily of quaternary Gold alloys, free from Iron and Palladium, and in particular free from Vanadium.

In particular, the applicant has carried out comparisons between the LRS 391 alloy and the LRS 386 alloy; these two alloys are both characterized by the same Gold concentration (791‰). As it can be observed in the chart of FIG. 2, all the alloys according to the concepts herein, equal to the 5N alloy show, in an environment containing Thioacetamide, a color variation curve according to the time that shows a stabilization inflection further than the color variation ΔE (L*, a*, b*) according to the time gains a substantial linearity. This stabilization inflection, for the alloys embodying the concepts herein, is comprised substantially between 2 and 4 hours.

The LRS 391 alloy shows, advantageously, an absolute color variation, with equal exposure time to Thioacetamide vapors, lower than the 5N ISO sample of the test, even if showing, after said stabilization inflection, a color variation according to the time that shows a slope substantially equal to the one assumed by the 5N alloy.

In detail, the replacement as above described permits to lower the slope of the curve of the color variation ΔE (L*, a*, b*) according to the exposure time to Thioacetamide vapors, in particular further than the stabilization inflection, both with respect to the slope assumed by the curve itself for the LRS 391 alloy, and with respect to the slope assumed by the curve itself for the 5N ISO alloy.

In order to increase even more the characteristics of resistance to color variation when the Gold alloys are exposed to Thioacetamide vapors, the applicant has provided for increasing the content of Gold with respect to the concentration of the LRS 386 alloy. She has so conceived the LRS 359 alloy, that shows an amount of Gold higher than 810‰ and in particular substantially equal to 812‰.

With respect to the LRS386 alloy, the LRS 359 alloy shows 21‰ more of Gold, that is compensated for by a reduction of Copper and Silver (−11‰ and −5‰ respectively) and Palladium (−5‰). The applicant, with the LRS 359 alloy, has obtained an alloy whose behavior, in Thioacetamide, is almost similar to the one detained by the LRS 386 alloy, but the curve of color variation ΔE (L*, a*, b*) thereof according to the exposure time to Thioacetamide vapors, shows, in particular after the stabilization inflection, a slope lower with respect to the slope assumed in the same conditions by the curve of color variation ΔE (L*, a*, b*) according to the exposure time to Thioacetamide vapors for the LRS 386 alloy.

From the second family, the Applicant has then conceived an subfamily of quaternary Gold alloys, with Gold concentration in the gap 831‰-834‰ and in particular substantially equal to 833‰, comprising various concentrations of Palladium. In particular, with the amount of Palladium comprised between 4‰ and 6‰, more preferably substantially equal to 5‰, the Copper is contained in the amount comprised between 142‰ and 146‰, and the Silver in the amount comprised between 12‰ and 22‰; alternatively, with the amount of Palladium comprised in the interval 14‰ and 17‰, more preferably 15‰, Copper is substantially comprised in the interval between 127‰ and 131‰, whereas Silver is substantially comprised in the interval between 19‰ and 25‰. The applicant has observed that this subfamily, and in particular the alloys whose content of Palladium is comprised in the interval between 14‰ and 17‰, more preferably 15‰, the resistance to the color variation in Thioacetamide, in air and in NaCl is maximized.

The graph of FIG. 2 shows also the behaviour of the LRS 387 alloy, that the applicant has conceived for observing the behavior with an increase of the concentration of Palladium on alloys resistant to the tarnishing with color according to the 5N ISO standard. In particular, the LRS 387 alloy has been conceived for verifying the behaviour of alloys with concentration of Palladium equal to or higher than 10‰. The applicant has conceived the 387 alloy that with respect to the LRS 359 alloy shows an increased Gold (+21‰) and Palladium (+10‰) concentration which are followed by a reduction of Copper (−24‰) and Silver (−7‰). In particular, in order to comply with the permanence within the limits of colors defined by the tolerances of the ISO standard for 5N alloys and, as well, to obtain a compromise of toughness and tarnishing resistance performances in environments containing Thioacetamide, the applicant has observed that the alloy, if with a concentration of Palladium equal to or higher than 10‰, must be free from Iron and have a quantity of Gold at least equal to 790‰ and more preferably 791‰ and a content of Copper higher than or equal to 154‰ and a content of Silver <37‰ and more in particular lower than or equal to 35‰; if in particular the content of Palladium is around 15‰, the applicant had to increase the concentration of Gold to a value equal to or higher than 831‰, and in particular to 833‰. As a matter of fact, the increase of the concentration of Palladium has caused a decrease of the saturation of the alloy color, that without an increase of Gold and a decrease of Copper with respect to the LRS 359 alloy would not have anymore been within the limits given by the ISO standard for 5N alloys. In its specific formulation, the LRS 387 alloy is almost at the limit of the tolerance of color given by the ISO standard for 5N alloys. However, the applicant has surprisingly discovered that the increase of the concentration of Gold and Palladium concurs to, further than lowering in its complex the susceptibility to tarnishing in environments with Thioacetamide vapors with respect to other ternary alloys such as ISO standard 5N alloy, also significantly lowering the variation of color that the alloy undergoes with respect to other alloys always quaternary Au—Cu—Ag—Pd, with percentages of Gold lower than 820‰ and of Copper higher than 140‰, as well as of Palladium substantially equal to or lower than 13‰.

More in detail, it has been surprisingly discovered that the use of quaternary Gold alloys with amount of Gold in the interval 831‰-834‰, Copper lower than 146‰ and Palladium higher than 5‰, and in particular amount of Copper lower than 131‰ and Palladium higher than 14‰, and more in particular almost equal to 15‰ permits to significantly level the inflection that the curve of variation of color ΔE (L*, a*, b*) according to the time of exposure to vapors of Thioacetamide has before and/or in correspondence of the stabilization inflection.

In other words, the curve of the color variation ΔE (L*, a*, b*) according to the exposure time to Thioacetamide vapors, before the arrival to the stabilization inflection, has a slope significantly lower with respect to the slope assumed by all the other alloys that are embodying the concepts herein, and in particular with a maximum ΔE gain (L*, a*, b*) of about 0.2 between 3 and 6 exposure hours.

The LRS 387 alloy shows, in particular, after 24 hours of exposure time to Thioacetamide vapors, a color variation lower than the color variation undergone by the LRS 359 alloy, having in fact a maximum ΔE (L*, a*, b*) after 24 hours of exposure lower than 2.4 and substantially equal to 2.25. Even if the concentration of Gold and Palladium ideally concur to conceive a ductile and not too tough Gold alloy, the LRS 359 shows also after annealing and strain hardening at 75‰ a toughness of 259 HV according to the HV5 measuring method, when the 5N alloy used as reference sample shows a toughness equal to 260 HV.

Alloys according to the concepts herein have been also studied in relation to the behavior when exposed to air; in particular, studies have been carried out for assessing the behavior adopted in terms of color variation ΔE (L*, a*, b*) according to the exposure time to air until a maximum of 800 hours from the moment of preparation and polishing of the sample.

It has been observed that all the Gold alloys according to table 1 show a color variation ΔE (L*, a*, b*), after 800 hours of time of exposure to air, significantly lower than the color variation ΔE (L*, a*, b*) assumed by the 5N alloy reference sample, and in particular at least 21‰ lower.

In particular, if the alloy is free from Iron, the color variation ΔE (L*, a*, b*) according to the time of exposure to air significantly decreases with respect to alloys containing Iron.

The applicant has observed that the alloys according to the concepts herein, in quaternary formulation, free from Iron and with:

Gold: in the amount comprised between 780‰, more preferably 790‰, and 840‰ in weight;

Copper: in the amount comprised between 125‰ and 167‰ in weight;

Silver: in the amount comprised between 15‰ and 54‰ in weight;

Platinum or Palladium, wherein the content of Platinum or Palladium is such that the assembly Gold, Copper, Silver and Platinum or Gold, Copper, Silver and Palladium reaches a percentage in weight at least equal to 980‰, and more preferably to 1000‰ are characterized by a color variation ΔE (L*, a*, b*) after 800 hours of time of exposure to air <0.8, and then show, in this case, a performance of 35‰ or more, better than the ISO 5N alloy used as reference sample.

In particular, the applicant has observed that the subfamily of quaternary Gold alloys, with concentration of Gold comprised between 831‰ and 834‰ and in particular substantially equal to 833‰, comprising an amount of Palladium comprised between 4‰ and 6‰, more preferably equal to 5‰, where Copper is contained in the amount comprised between 142‰ and 146‰, and Silver in the amount comprised between 12‰ and 22‰, characterized by a color variation ΔE (L*, a*, b*) after 800 hours of exposure time to air <0.83 and typically lower than or equal to 0.78.

The applicant has observed that the subfamily of quaternary Gold alloys, with concentration of Gold comprised between 831‰ and 834‰ and in particular substantially equal to 833‰, with an amount of Palladium comprised in the interval between 14‰ and 17‰, more preferably equal to 15‰, where Copper is substantially comprised in the interval between 127‰ and 131‰, whereas Silver is substantially comprised in the interval between 19‰ and 25‰, the color variation ΔE (L*, a*, b*) after 800 hours of time of exposure to air is always lower than 0.72 and typically lower than or equal to 0.7.

From a specific comparison among LRS 359, LRS 386, LRS 387 and LRS 391 alloys, the applicant has observed that an increase in the concentration of Gold, in a quaternary alloy as the one referred to in the previous paragraph is not sufficient for expressing an improvement of the characteristics of resistance to tarnishing in the air without considering also the percentages of other elements Copper, Silver, Platinum or Palladium. In particular, in fact, the applicant has observed that, for concentrations of Gold of equal value, preferably comprised between 780‰, more preferably 790‰ and 800‰, and in particular for concentrations of Gold comprised between 790‰ and 792‰, and for amount of Copper and Silver substantially equal, and comprised in the interval 164‰ and 167‰ and respectively 35-37‰, the replacement of Platinum at 5‰ with Palladium at 10‰ does not cause substantial variations of performances of the alloy (comparison between LRS 391 and 386 alloys).

Figure 11:
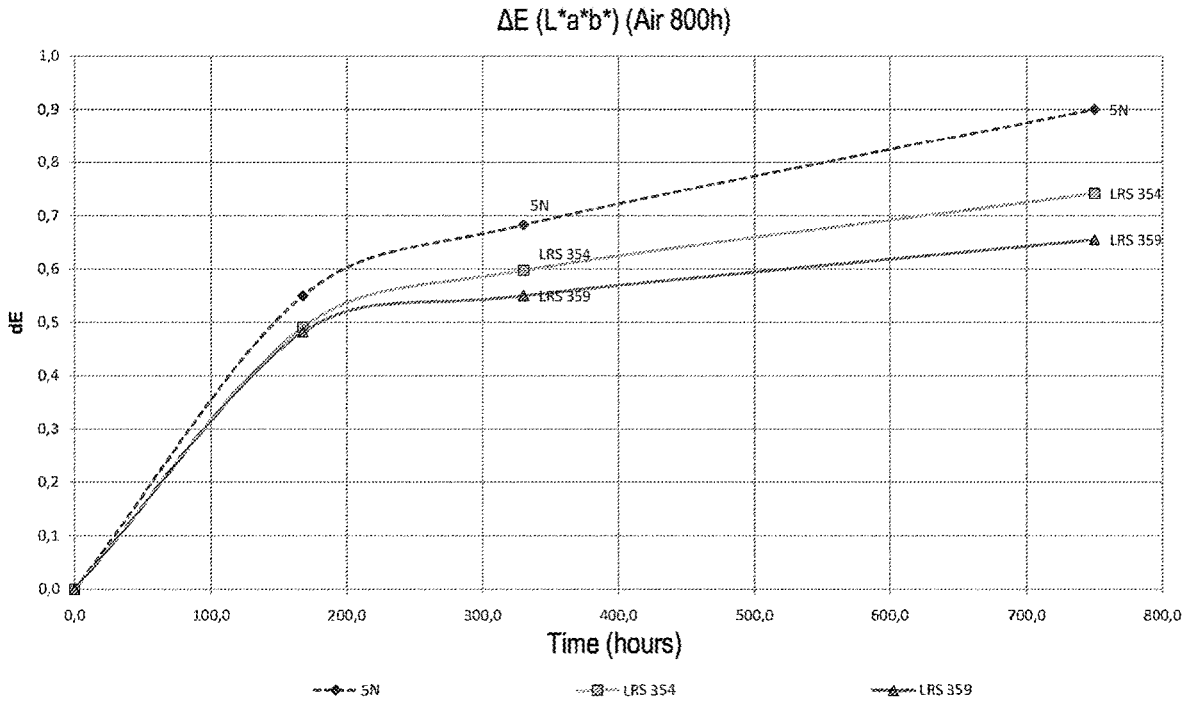
FIG. 11 shows a color variation chart according to the time of exposure to air for LRS 354 and LRS 359 alloys embodying the concepts herein, in relation to the color variation assumed by the 5N alloy according to the ISO composition used as reference sample.
Figure 12:
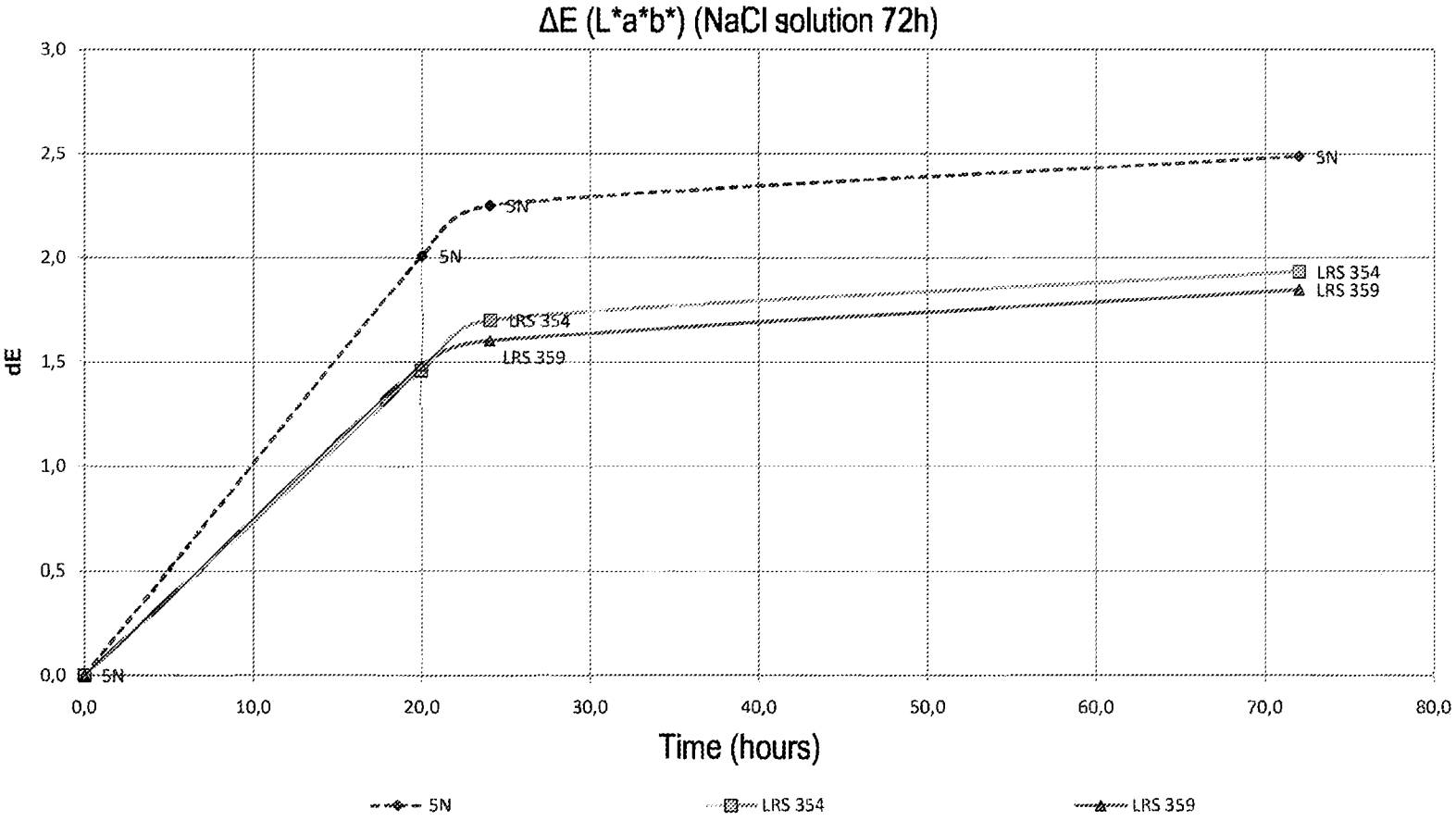
FIG. 12 shows a color variation chart according to the time of exposure to 50 g/L NaCl solutions for LRS 354 and LRS 359 alloys embodying the concepts herein, in relation to the color variation assumed by the 5N alloy according to the ISO composition used as reference sample.
Figure 13:
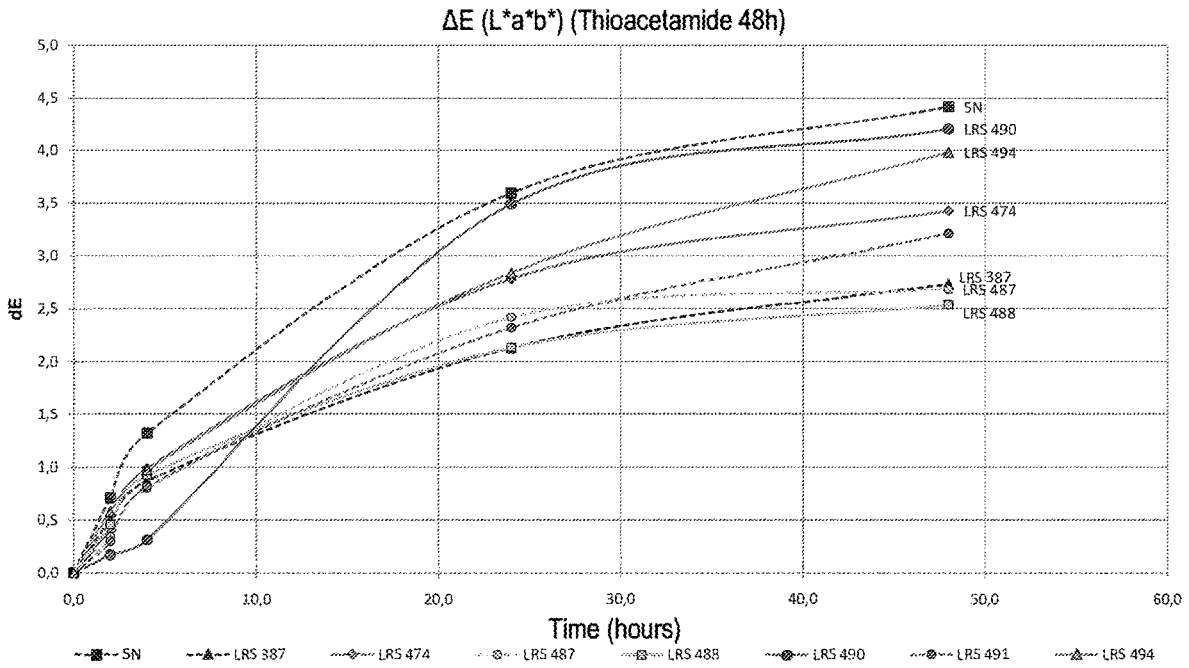
FIG. 13 shows a color variation chart according to the time of exposure to Thioacetamide according to the UNI EN ISO 4538:1998 for other alloys according to the concepts herein and in relation to the color variation assumed by the 5N alloy according to the ISO composition used as reference sample.
Figure 14:
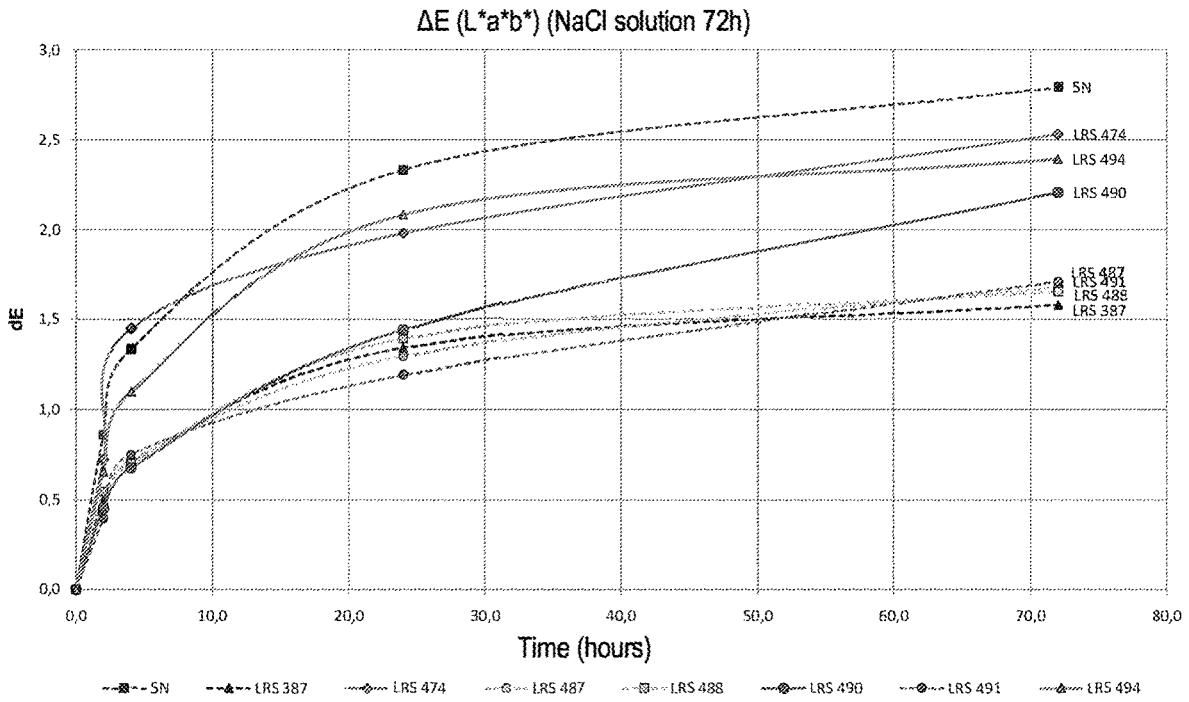
FIG. 14 shows a color variation chart according to the time of exposure to a 50 g/L NaCl solution for other alloys according to the concepts herein and in relation to the color variation assumed by the 5N alloy according to the ISO composition used as reference sample.

In the comparison between LRS 391 and LRS 359 alloys, an increase of Gold (+21‰) and a contextual reduction of Copper (−14‰) and Silver (−7‰) does not necessarily cause an increase of performances in terms of reduction of color variation in air. From the observation of the behaviour in air of the color variation of the LRS 359 and LRS 354 alloy (graph according to FIG. 11), furthermore, the applicant has observed that by increasing the Gold content from 812‰ to 833‰, keeping constant the Palladium concentration (5‰) and reducing in proportion Copper (−9‰) and Silver (−12‰), after 800 hours of exposure to air, the difference in color variation assumed by the two alloys is equal to approximately 0.2.

What has been surprisingly observed is that values of Palladium higher than 14% and anyhow comprised in the interval 14‰-17‰, more preferably in the interval 14‰-16‰, in particular in Gold-Silver-Copper-Palladium quaternary alloys with concentration of Gold at least equal to 831‰ and anyhow comprised in the interval 831‰-834‰, cause a significant increase of the performances of the alloy in air in terms of resistance to color variation. In fact, between the LRS 354 alloy and the LRS 387 alloy, the content of Gold is the same (833‰) and there is a replacement of the Copper-Silver binary combination with a corresponding increase of the concentration of Palladium, in favor of the LRS 387 alloy wherein Palladium gains the concentration equal to 15‰ and Copper and Silver concentrations equal to 129‰ and 23‰ in weight respectively.

In this case the behavior of the alloy notably improves with respect to the others, and at 800 hours of exposure to air the LRS 387 alloy—the best among the ones tested by the applicant as for the resistance to tarnishing in exposure to air—shows performances optimized by 13‰ with respect to the LRS 386 alloy that is moreover the one immediately subsequent in terms of absolute resistance in this case.

The applicant has also done tests in solution containing 50 g/L of NaCl, in particular for LRS 386, 387 and 431 alloys.

Figure 4:
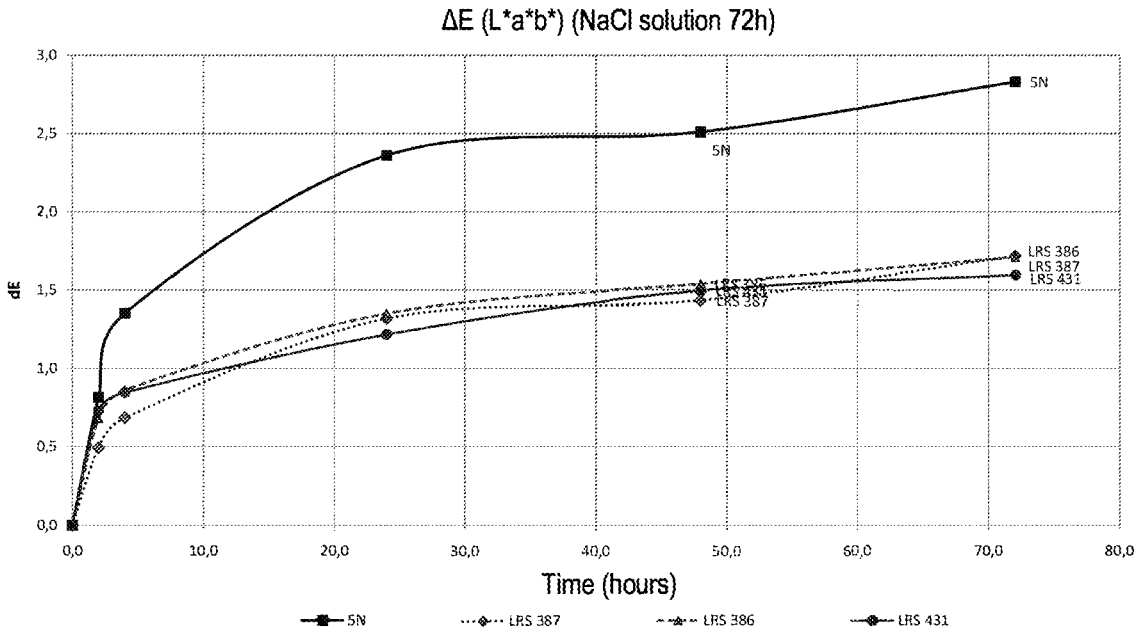
FIG. 4 shows a color variation chart according to the time of exposure to a 50 g/L NaCl solution for part of the alloys embodying the concepts herein (LRS 386, LRS 387, LRS 431), in relation to the color variation assumed by the 5N alloy according to the ISO composition used as reference sample.
Figure 5:
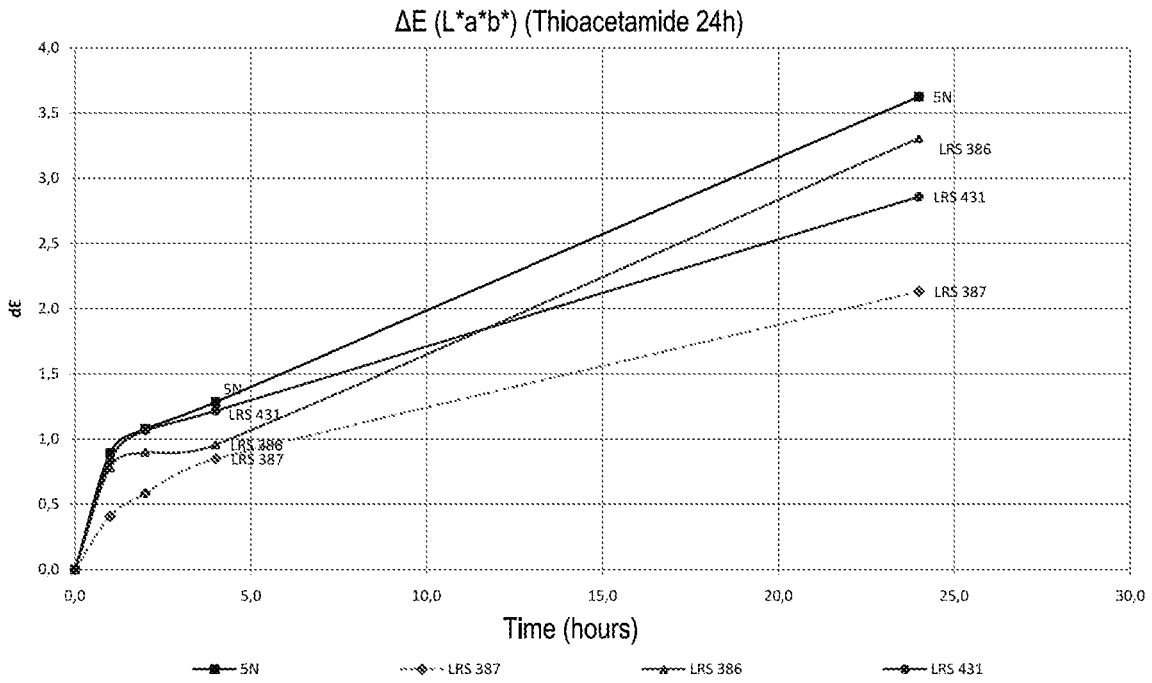
FIG. 5 shows a color variation chart according to the time of exposure to Thioacetamide for part of the alloys embodying the concepts herein (LRS 386, LRS 387, LRS 431), in relation to the color variation assumed by the 5N alloy according to the ISO composition used as reference sample.
Figure 6:
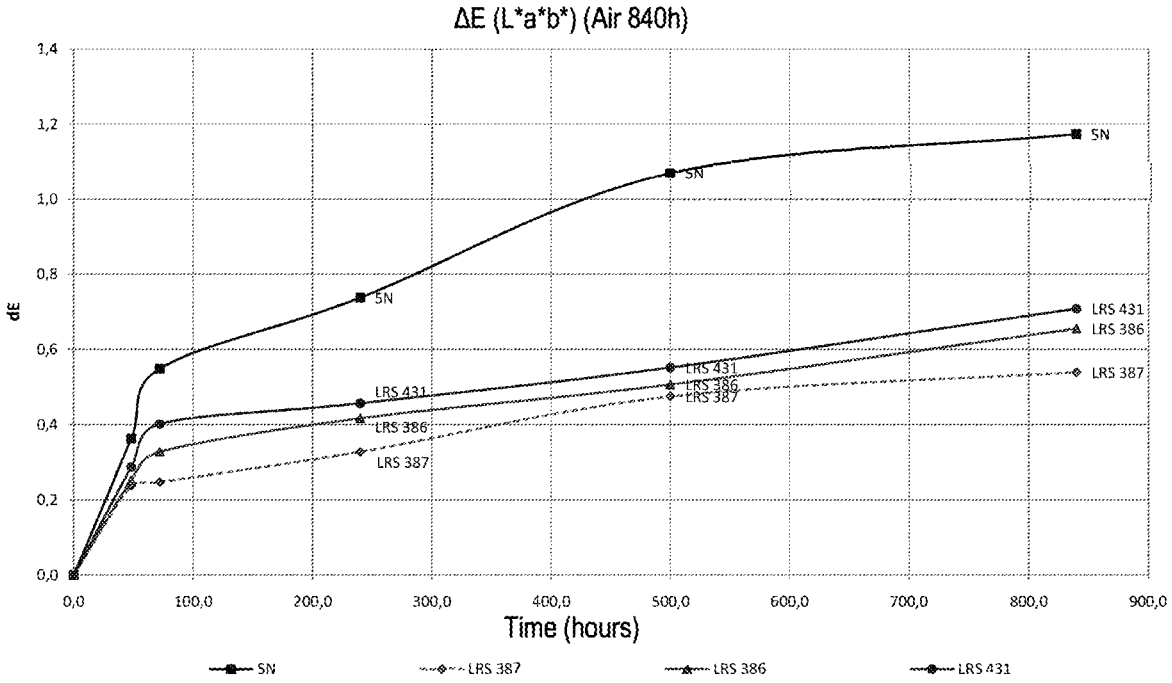
FIG. 6 shows a color variation chart according to the time of exposure to air for part of the alloys embodying the concepts herein (LRS 386, LRS 387, LRS 431), in relation to the color variation assumed by the 5N alloy according to the ISO composition used as reference sample.

The graph of FIG. 4 shows the color variation curve ΔE (L*, a*, b*) of LRS 386, 387 and 431 alloys according to the time of exposure to a solution containing 50 g/L of NaCl, in comparison to the 5N ISO alloy used as reference sample.

The applicant has specifically observed that all the alloys embodying the concepts herein, and in particular the LRS 386, LRS 387 and LRS 431 alloys, show a behaviour significantly better with respect to the ternary 5N ISO used as reference sample; since these specific embodiments for the alloys embodying the concepts herein are characterized by concentrations of Gold significantly different among them (between 791‰ and 833‰), it has been observed that what influences more in the improvement of the characteristics in terms of resistance to tarnishing in environments containing Sodium Chloride is the presence of Palladium, specifically in percentages at least equal to 10‰ in weight.

The applicant has finally observed that another parameter to take into account in the analysis of the color variation of a Gold alloy, is the trend of the color variation in terms of absolute values, because the measurement only of color variation ΔE (L*, a*, b*), is not enough for determining with precision which color gains the alloy after a determined period of exposure to air or to an chemically aggressive environment, in particular containing Thioacetamide or NaCl solutions. It is then important to assess how the color varies in terms of absolute values with respect to the target color defined by the ISO DIS 8654:2017 standard. In particular, the applicant has observed that the Gold alloys when realized, independently from being or not transformed and/or processed for realizing items of jewelry or jewels, can remain exposed, at least to air, for significant times; the parameter of measurement of the exposure to air at 800 hours is then appropriate. The applicant cared to search for formulations for the Gold alloy that permit to obtain the keeping of the color within the limits defined by the ISO DIS 8654:2017 standard for the compositions compliant with the ISO norm for 5N alloys in air even higher than 800 hours, and in particular until 840 hours.

Figure 7:
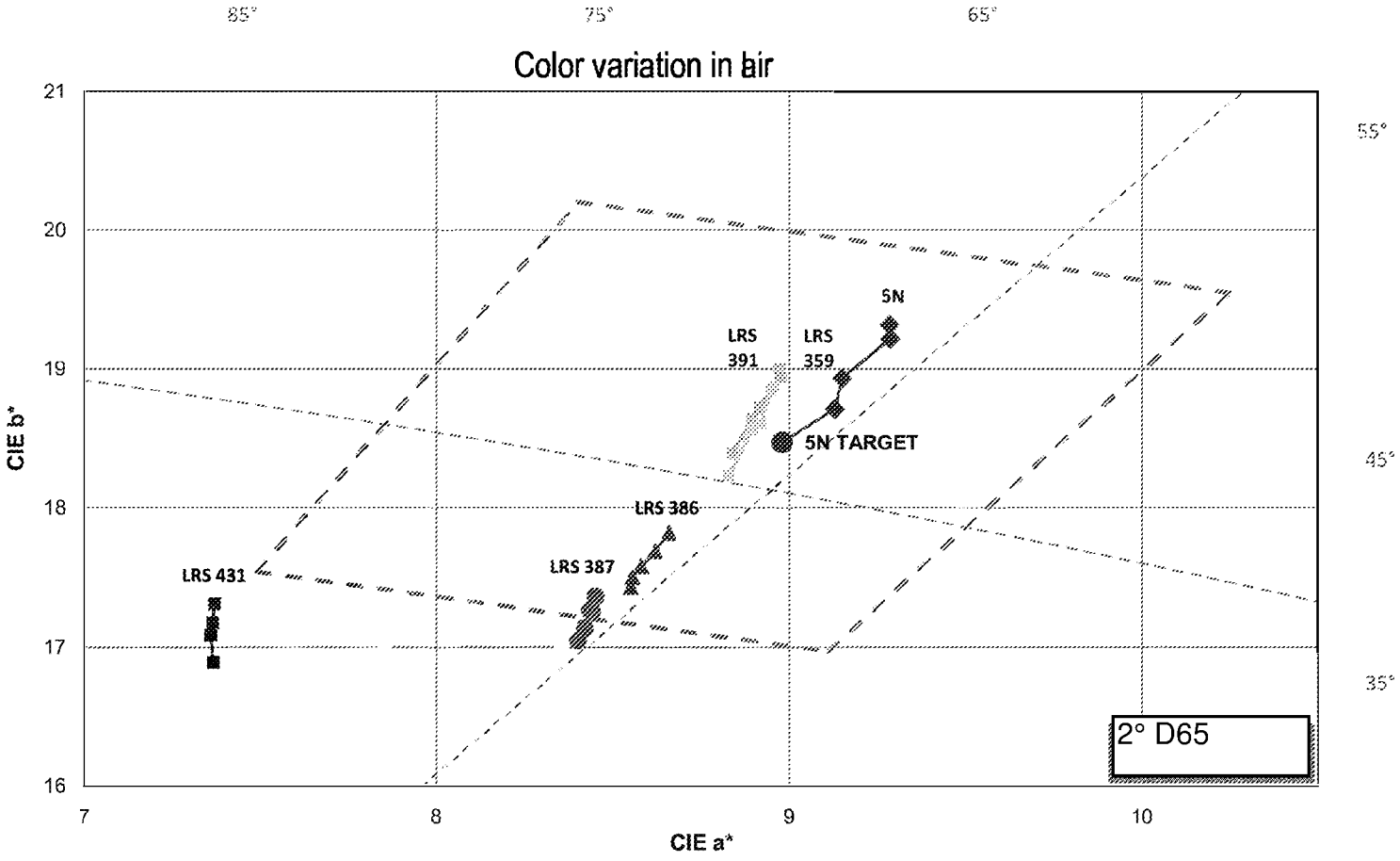
FIG. 7 shows a CIELAB 1976 color space portion where it is shown how the color of some alloys of the concepts herein evolves at 0, 72, 240, 500, 840 h of exposure to air.
Figure 8:
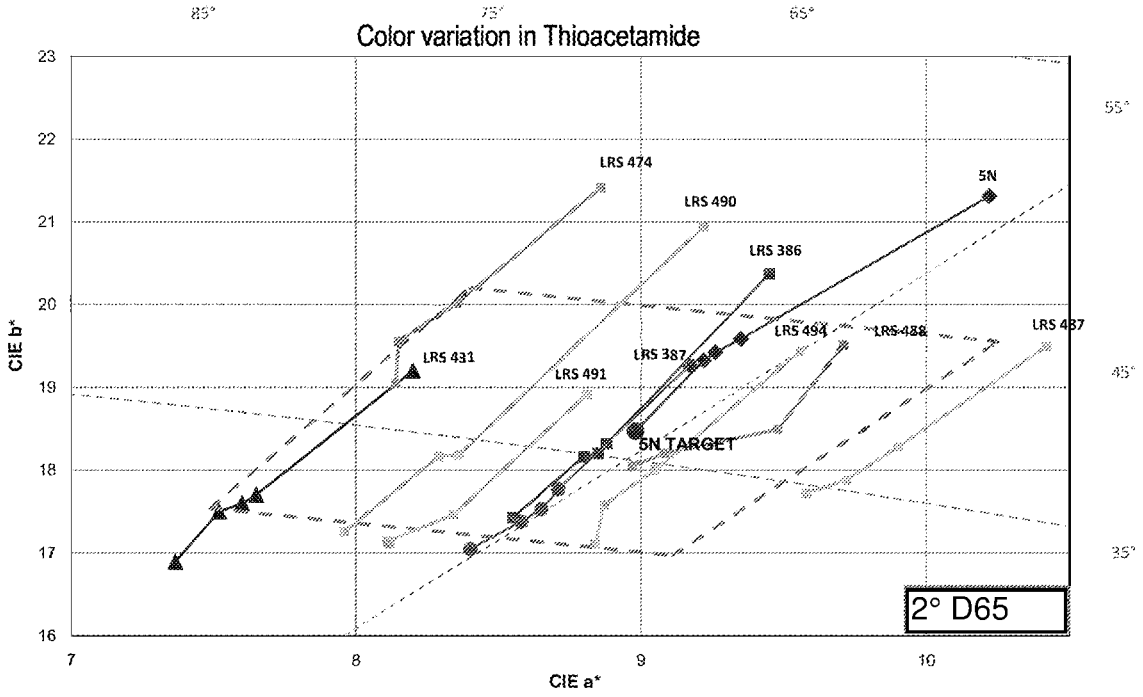
FIG. 8 shows a CIELAB 1976 color space portion where it is shown how the color of some alloys of the concepts herein evolves at 1, 2, 4, 24 h of exposure to Thioacetamide according to UNI EN ISO 4538:1998.
Figure 9:
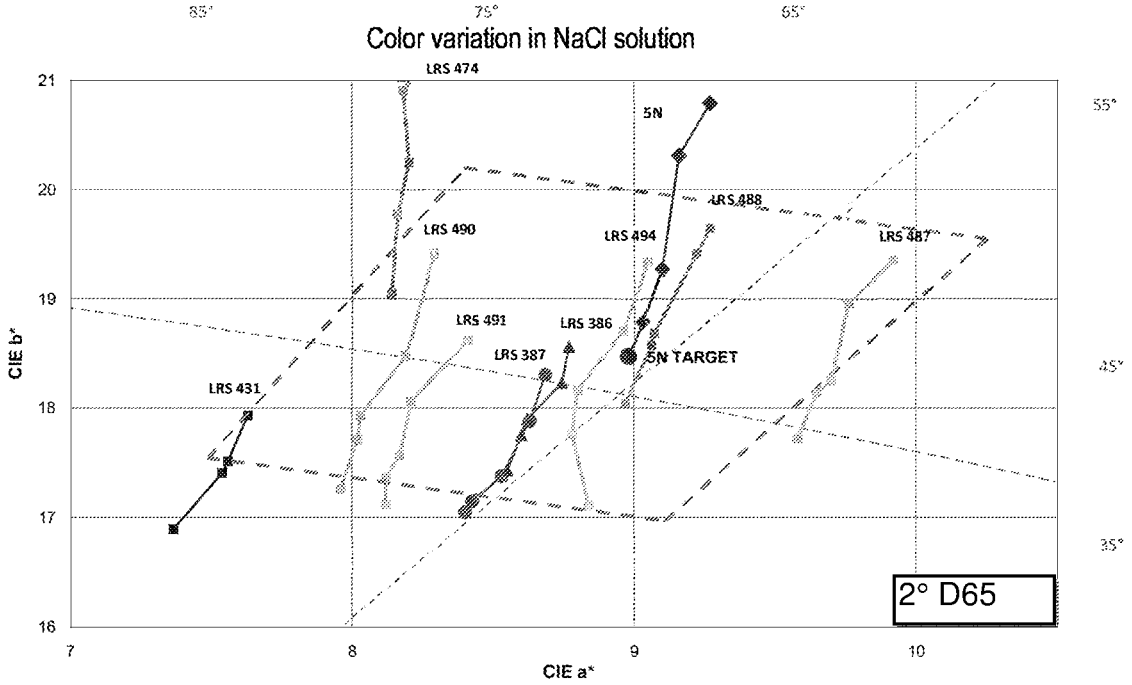
FIG. 9 shows a CIELAB 1976 color space portion where it is shown how the color of some alloys of the concepts herein evolves at 0, 2, 4, 24, 72 h of exposure to a 50 g/L NaCl solution.
Figure 10:
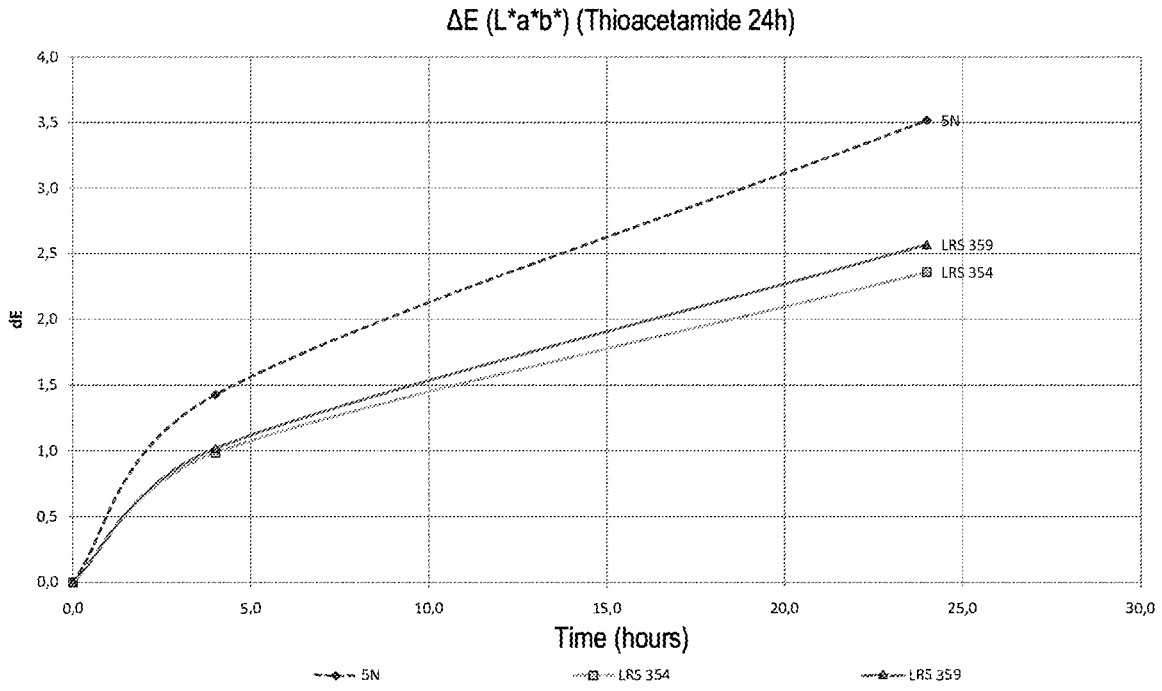
FIG. 10 shows a color variation chart according to the time of exposure to Thioacetamide according to the UNI EN ISO 4538:1998 for LRS 354 and LRS 359 alloys embodying the concepts herein, in relation to the color variation assumed by the 5N alloy according to the ISO composition used as reference sample.

The tests of color variation in terms of time of exposure to a chemically aggressive environment have been done also in an environment containing Thioacetamide and Sodium Chloride. The graphs according to FIGS. 7, 8 and 9 show the path of the color evolution of LRS 386 and LRS 387 alloys in relation to the 5N ISO alloy used as reference sample in air and in Thioacetamide and—respectively—NaCl, under the conditions described at the beginning of the description. In particular, for the exposure to Thioacetamide, colors were assessed after 1, 2, 4 and 24 hours. For the exposure to NaCl, colors were assessed at 0, 2, 4, 24 and 72 h, whereas in air the colors were assessed at 0, 72, 240, 500, 840 h.

It has been observed that the alloy in accordance to the reference sample according to the 5N ISO standard object of the test, already after 24 hours, and even more after 72 hours, is not anymore able to comply with the color limits given by the ISO DIS 8654:2017 standard for 5N alloys. The influence of Palladium, in particular in the amount higher than 10‰, is crucial in the described formulations, for obtaining alloys that even after 72 hours of exposure to solutions of Sodium Chloride show a color still compatible with the ISO DIS 8654:2017 standard. The applicant has observed then that the quaternary Gold alloys, with concentration of Gold at least equal to 790‰ and anyhow comprised at least in the interval 790‰-840‰ and concentration of Palladium at least equal to 10‰, free from Iron, with concentrations of Copper comprised between 127‰ and 167‰, and of Silver comprised between 23‰ and 37‰, and in particular the LRS 386 and LRS 387 formulations are able to stay within the color limits given by the ISO DIS 8654:2017 standard for 5N alloys.

When exposed to an environment containing Thioacetamide, the applicant has observed that LRS 386 and LRS 387 alloys, at least for the first 4 hours of exposure keep a color always within the limits given by the ISO DIS 8654:2017 for 5N alloys; the LRS 386 alloy since it has a high concentration of Gold and Palladium (833‰ and 15‰ respectively) and its color is basically (0 hours) next to the lower limit of the standard being in particular the b* parameter at the minimal limit of the tolerance given by the standard, also after 24 hours of exposure to Thioacetamide keeps a color compatible with the one of 5N as defined according to the ISO DIS 8654:2017 standard.

In the same time interval, the alloy according to the 5N ISO standard used as reference sample keeps a resistance to discoloration significantly worse with respect to both the LRS 386 alloy and the LRS 387 alloy, exiting significantly from the color limits given by the ISO DIS 8654:2017 standard for 5N alloys; in particular, already after only 4 hours, the color assumed by the 5N ISO alloy in the reference sample is at the limit of the given tolerance of color.

The applicant has also conceived within the main claimed family, specific formulations for the Gold alloys, in particular LRS 431 and LRS 432, that are quinary alloys, that show a color at the limits of the tolerance given by the ISO DIS 8654:2017 standard for 5N alloys, and that—at least under determined conditions, fully enter within the limits of color given by the above mentioned standard.

In particular, the LRS 431 and 432 alloys after to a family of alloys comprising: Gold in the amount comprised between 790‰ and 800‰, Palladium in the amount comprised between 4‰ and 17‰, preferably between 4‰ and 16‰, even more preferably comprised between 5‰ and 15‰, and Silver comprised between 35‰ and 40‰, within which Copper is comprised between 157‰ and 160‰ and more preferably is substantially equal to 158‰ and wherein there is Iron in the amount comprised between 3‰ and 7‰. The applicant has observed that these alloys, in particular after a partial tarnishing, show a color fully compatible with the ISO DIS 8654:2017 standard for 5N alloys.

The alloys according to the concepts herein can be free from materials susceptible to generate carbides and/or oxides and in particular free from Vanadium. This permits to the considered alloys to keep a particular quality when processed. In particular, the alloys according to the concepts herein can be free from Magnesium, Indium, Silicon, Tin, Titanium, Tungsten, Molybdenum, Niobium, Tantalum, Zirconium, Yttrium, Rhenium, Germanium. It has been particularly observed that the Silicon opacifies a lot the color of the resulting alloy, so even minimal additions of Silicon in an alloy according to the here described formulations, would make the resulting alloy with a color not compatible with the color tolerances of the 5N alloys, in particular according to the ISO DIS 8654:2017 standard. In addition, Silicon causes the formation of inclusions, often of significant size, which are not convenient when alloys for high quality jewelry items, such as those described here, have to be produced.

The alloys according to the concepts herein can furthermore expressly be free from Nickel, Cobalt, Arsenic and Cadmium. This makes them suitable to be used also for making jewels or parts of jewelry items in contact with the skin.

The alloys according to the concepts herein, with the exception of the family of alloys to which the LRS 431 and 432 alloys belong, can be Iron-free alloys; this advantageously allows to optimize the behaviour of the alloy in solutions containing NaCl, since the Iron deteriorates its behaviour, worsening the resistance to tarnishing per unit of time in the aforesaid solutions.

Without prejudice to the exclusion of unintended impurities, alloys according to the concepts herein can include additional metals in total amount, i.e. as a sum, not higher than 2‰ and more preferably not higher than 1‰; the list of said additional materials includes Iridium, Ruthenium and Rhenium. These materials can have, under certain conditions better explained hereinafter, grain refining properties. Finally, this list also includes Zinc, as an element capable of reducing the content of oxygen dissolved in the alloy during the melting process.

In particular, Iridium is preferably used in alloys containing high Copper contents, as it has a wide range of miscibility with the latter element; preferably, but non-limiting thereto, if present, Iridium is present in an amount equal to or lower than 0.3‰ in weight; instead, Zinc may be present in an amount equal to or lower than 0.5‰ in weight.

Rarer is the use of Ruthenium and Rhenium, in the amount of up to 0.1‰ in weight. Ruthenium and Rhenium are preferably used in white or grey Gold alloys containing high levels of Palladium.

However, it is noted that the use of Iridium, Rhenium and/or Ruthenium is subject to the inclusion of these elements in pre-alloys. In fact, it has been observed that these elements, if not pre-alloyed with the material with affinity thereto, but directly introduced into the pot, do not form alloy, thus contributing to a worsening of the characteristics of the alloy. On the other hand, only if used in pre-alloy with Copper (Iridium) or Palladium (Rhenium and Ruthenium), taking care to make the pre-alloy bind with the rest of the elements composing the alloy itself, results the property of grain refining.

The concepts herein encompass a process of production of a Gold alloy having color compatible with the ISO DIS 8654:2017 5N standard.

The Gold alloys embodying the concepts herein are made from pure elements, in particular from Gold at 99.99‰, Cu at 99.99‰, Pd at 99.95‰, Fe at 99.99‰, Ag at 99.99‰, Pt at 99.95‰.

The process of melting of pure elements for the creation of the Gold alloys according to the concepts herein can be in detail a process of discontinuous melting of Gold or a process of continuous melting of Gold. The process of discontinuous melting of Gold is a process in which the mixture is melted and cast into a form or ingot mould, made of graphite. In this case the above mentioned elements are melted and cast in a controlled atmosphere. More in particular, the melting operations are carried out only after having preferably conducted at least 3 conditioning cycles of the atmosphere of the melting chamber. This conditioning involves first of all reaching a vacuum level up to pressures lower than $1\times10^{-2}$ mbar and a subsequent partial saturation with Argon at 500 mbar. During the melting, the Argon pressure is kept at pressure levels between 500 mbar and 800 mbar. When the complete melting of the pure elements has been reached, a step of overheating of the mixture takes place, in which the mixture is heated up to a temperature of about 1250° C., and in any case to a temperature above 1200° C., in order to homogenize the chemical composition of the metal bath. During the overheating step, the pressure value in the melting chamber again reaches a vacuum level lower than $1\times10^{-2}$ mbar.

At this point, in a casting step, the melted material is casted into a mould or ingot mould and the melting chamber is again pressurized with an inert gas, preferably argon, injected at a pressure of less than 800 mbar and in particular lower than 700 mbar.

After solidification, the bars or casts are extracted from the bracket. After the solidification of the alloy are obtained Gold alloy bars or casts which are subjected to a quick cooling by means of a step of immersion in water, in order to reduce and possibly avoid solid state phase transformations. In other words, the bars or casts are subjected to a quick cooling step, preferably but non-limiting in water, in order to avoid phase variations in the solid state.

The process of continuous melting of Gold is a process in which solidification and extraction of the solidified Gold are continuously carried out from one free end of a Gold bar or cast. In particular, a graphite die is used in the continuous melting process. The use of graphite dies is known, since graphite is a solid lubricant, and typically has low friction between its surfaces and those of the solidified metal, typically permitting to obtain an easy extraction of the element contained therein without fractures and with the minimum amount of defects present on its surface.

In a more general embodiment, the production process of the Gold alloy according to the concepts herein comprises, starting from the pure elements according to the above, a mixing step of elements according to the present disclosure, and in particular:

Gold: in the amount comprised between 780‰, more preferably 790‰, and 840‰ in weight;

Copper: in the amount comprised between 125‰ and 167‰ in weight;

Silver: in the amount comprised between 15‰ and 54‰ in weight;

Platinum or Palladium, wherein the content of Platinum or Palladium is such that the assembly Gold, Copper, Silver and Platinum or Gold, Copper, Silver and Palladium reaches a percentage at least equal to 980‰, and more preferably the 1000‰ in weight of the alloy which are subsequently introduced into the melting pot in the amounts specified above.

In the mixing step above described, the pure basic elements are mixed in such a way as to obtain a homogeneous mixture, i.e. without portions or areas marked, in particular significantly, by an excess of one element with respect to the others. When the inclusion of elements such as Iridium, Ruthenium and Rhenium is present for grain refinement, the production process comprises a step of production of a pre-alloy, in which said pre-alloy comprises:

a) Iridium pre-alloyed to Copper in the already indicated amounts, or alternatively b) Rhenium or Ruthenium pre-alloyed to Palladium in the already indicated amounts.

Subsequently, the bars or casts obtained by discontinuous or continuous fusion are subjected to a step of hot or cold plastic deformation, preferably but non-limiting to flat rolling.

During flat rolling and more generally during the cold plastic processing steps, the different compositions melted according to the above described procedure are deformed by more than 60‰ and then subjected to a heat treatment of recrystallization at a temperature higher than 650° C., in order to be subsequently cooled.

The following tables show the values of color variation assumed by the alloys according to the specific forms of production LRS 359, 386, 387, 391 and 431 in relation to a reference sample with composition made according to the 5N ISO standard. In particular, the first and second tables show the values of color variation assumed by the above mentioned alloys when exposed to Thioacetamide (test 1 and test 2), the third and fourth tables show the values of color variation assumed by the above mentioned alloys when exposed to air (test 1 and test 2) and the fifth table shows the values of color variation assumed by the above mentioned alloys when exposed to 50 g/L solution.

Thioacetamide (test 1)
ΔE (L *, a*, b*)

| ALLOY | 0 h | 4 h | 24 h |
|---|---|---|---|
| 5N | 0.00 | 1.27 | 3.58 |
| LRS 359 | 0.00 | 1.02 | 2.57 |
| LRS 386 | 0.00 | 1.07 | 2.95 |
| LRS 387 | 0.00 | 0.74 | 2.25 |
| LRS 391 | 0.00 | 1.05 | 3.27 |

Thioacetamide (test 2)
ΔE (L*, a*, b*)

| ALLOY | 0 h | 1 h | 2 h | 4 h | 24 h |
|---|---|---|---|---|---|
| 5N | 0 | 0.89 | 1.08 | 1.28 | 3.62 |
| LRS 387 | 0 | 0.41 | 0.58 | 0.85 | 2.13 |
| LRS 386 | 0 | 0.78 | 0.90 | 0.96 | 3.31 |
| LRS 431 | 0 | 0.84 | 1.07 | 1.22 | 2.86 |

Air (test 1)
ΔE (L*, a*, b*)

| ALLOY | 0 h | 72 h | 168 h | 800 h |
|---|---|---|---|---|
| 5N | 0.00 | 0.34 | 0.43 | 0.95 |
| LRS 359 | 0.00 | 0.34 | 0.40 | 0.68 |
| LRS 386 | 0.00 | 0.28 | 0.41 | 0.60 |
| LRS 387 | 0.00 | 0.30 | 0.39 | 0.53 |
| LRS 391 | 0.00 | 0.27 | 0.39 | 0.63 |

Air (test 2)
ΔE (L*, a*, b*)

| ALLOY | 0 h | 48 h | 72 h | 240 h | 500 h | 840 h |
|---|---|---|---|---|---|---|
| 5N | 0 | 0.36 | 0.55 | 0.74 | 1.07 | 1.17 |
| LRS 387 | 0 | 0.24 | 0.25 | 0.33 | 0.47 | 0.54 |
| LRS 386 | 0 | 0.25 | 0.33 | 0.42 | 0.51 | 0.65 |
| LRS 431 | 0 | 0.29 | 0.40 | 0.46 | 0.55 | 0.71 |

50 g/L NaCl solution
ΔE (L*, a*, b*)

| ALLOY | 0 h | 2 h | 4 h | 24 h | 48 h | 72 h |
|---|---|---|---|---|---|---|
| 5N | 0 | 0.8 | 1.4 | 2.4 | 2.5 | 2.8 |
| LRS 387 | 0 | 0.5 | 0.7 | 1.3 | 1.4 | 1.7 |

-continued 50 g/L NaCl solution
ΔE (L*, a*, b*)

| ALLOY | 0 h | 2 h | 4 h | 24 h | 48 h | 72 h |
|---|---|---|---|---|---|---|
| LRS 386 | 0 | 0.7 | 0.9 | 1.3 | 1.5 | 1.7 |
| LRS 431 | 0 | 0.7 | 0.8 | 1.2 | 1.5 | 1.6 |

Colors (L*, a*, b*) assumed in the air according to the exposure time

| | 5N | | |
|---|---|---|---|
| | L* | a* | b* |
| 0 h | 87.2 | 8.48 | 18.47 |
| 72 h | 87.4 | 8.63 | 18.71 |
| 240 h | 87.3 | 8.65 | 18.93 |
| 500 h | 87.1 | 8.79 | 19.21 |
| 840 h | 87.0 | 8.79 | 19.31 |

| | LRS 386 | | |
|---|---|---|---|
| | L* | a* | b* |
| 0 h | 86.0 | 8.05 | 17.43 |
| 72 h | 86.1 | 8.05 | 17.50 |
| 240 h | 86.1 | 8.08 | 17.58 |
| 500 h | 86.2 | 8.12 | 17.69 |
| 840 h | 86.1 | 8.16 | 17.82 |

| | LRS 387 | | |
|---|---|---|---|
| | L* | a* | b* |
| 0 h | 86.0 | 7.90 | 17.05 |
| 72 h | 86.4 | 7.92 | 17.14 |
| 240 h | 86.2 | 7.93 | 17.26 |
| 500 h | 86.4 | 7.94 | 17.26 |
| 840 h | 86.3 | 7.95 | 17.36 |

| | LRS 431 | | |
|---|---|---|---|
| | L* | a* | b* |
| 0 h | 86.6 | 6.87 | 16.89 |
| 72 h | 86.6 | 6.86 | 17.08 |
| 240 h | 86.7 | 6.86 | 17.17 |
| 500 h | 86.5 | 6.87 | 17.31 |
| 840 h | 86.5 | 6.90 | 17.41 |

| | LRS 359 | | |
|---|---|---|---|
| | L* | a* | b* |
| 0 h | 86.5 | 8.33 | 18.23 |
| 72 h | 86.4 | 8.40 | 18.56 |
| 240 h | 86.4 | 8.42 | 18.60 |

-continued

| | LRS 359 | | |
|---|---|---|---|
| | L* | a* | b* |
| 500 h | 86.3 | 8.45 | 18.85 |
| 840 h | 86.3 | 8.46 | 18.87 |

| | LRS 391 | | |
|---|---|---|---|
| | L* | a* | b* |
| 0 h | 86.9 | 8.34 | 18.90 |
| 72 h | 86.8 | 8.40 | 18.64 |
| 240 h | 86.7 | 8.42 | 18.72 |
| 500 h | 86.6 | 8.48 | 18.94 |
| 840 h | 86.6 | 8.47 | 19.00 |

Colors assumed by the alloys in Thioacetamide

| | 5N | | |
|---|---|---|---|
| | L* | a* | b* |
| 0 h | 87.2 | 8.48 | 18.47 |
| 1 h | 86.9 | 8.82 | 19.42 |
| 2 h | 86.7 | 8.86 | 19.58 |
| 4 h | 86.6 | 8.91 | 19.80 |
| 24 h | 84.8 | 9.84 | 22.80 |

| | LRS 386 | | |
|---|---|---|---|
| | L* | a* | b* |
| 0 h | 86.0 | 8.05 | 17.43 |
| 1 h | 85.6 | 8.30 | 18.16 |
| 2 h | 85.5 | 8.35 | 18.20 |
| 4 h | 85.6 | 8.38 | 18.32 |
| 24 h | 84.9 | 8.95 | 20.37 |

| | LRS 387 | | |
|---|---|---|---|
| | L* | a* | b* |
| 0 h | 86.0 | 7.90 | 17.05 |
| 1 h | 85.9 | 8.08 | 17.38 |
| 2 h | 85.8 | 8.15 | 17.53 |
| 4 h | 85.6 | 8.21 | 17.77 |
| 24 h | 84.5 | 8.67 | 19.26 |

| | LRS 431 | | |
|---|---|---|---|
| | L* | a* | b* |
| 0 h | 86.6 | 6.87 | 16.89 |
| 1 h | 86.0 | 7.02 | 17.50 |
| 2 h | 85.8 | 7.10 | 17.60 |

-continued

| | LRS 431 | | |
|---|---|---|---|
| | L* | a* | b* |
| 4 h | 85.7 | 7.15 | 17.70 |
| 24 h | 85.1 | 7.70 | 19.20 |

Colors assumed by the alloys in 50 g/L NaCl solution

| | 5N | | |
|---|---|---|---|
| | L* | a* | b* |
| 0 h | 87.2 | 8.48 | 18.47 |
| 2 h | 88.0 | 8.53 | 18.79 |
| 4 h | 88.0 | 8.60 | 19.27 |
| 24 h | 87.0 | 8.66 | 20.31 |
| 72 h | 87.6 | 8.77 | 20.79 |

| | LRS 386 | | |
|---|---|---|---|
| | L* | a* | b* |
| 0 h | 86.0 | 8.05 | 17.43 |
| 2 h | 86.9 | 8.10 | 17.75 |
| 4 h | 86.6 | 8.12 | 17.90 |
| 24 h | 86.1 | 8.25 | 18.23 |
| 72 h | 85.9 | 8.27 | 18.56 |

| | LRS 387 | | |
|---|---|---|---|
| | L* | a* | b* |
| 0 h | 86.0 | 7.90 | 17.05 |
| 2 h | 86.3 | 7.93 | 17.15 |
| 4 h | 86.3 | 8.03 | 17.38 |
| 24 h | 86.0 | 8.13 | 17.88 |
| 72 h | 85.9 | 8.19 | 18.31 |

| | LRS 431 | | |
|---|---|---|---|
| | L* | a* | b* |
| 0 h | 86.6 | 6.87 | 16.89 |
| 2 h | 87.0 | 7.04 | 17.41 |
| 4 h | 86.3 | 7.06 | 17.51 |
| 24 h | 86.4 | 7.13 | 17.93 |
| 72 h | 86.1 | 7.17 | 18.25 |

| | LRS 474 | | |
|---|---|---|---|
| | L* | a* | b* |
| 0 h | 87.1 | 7.64 | 19.05 |
| 2 h | 87.0 | 7.66 | 19.77 |
| 4 h | 87.9 | 7.70 | 20.25 |
| 24 h | 87.7 | 7.68 | 20.91 |
| 72 h | 87.3 | 7.86 | 21.56 |

The following table shows the hardness data collected by the applicant for the alloys embodying the concepts herein.

| | HV5 | | | |
|---|---|---|---|---|
| | 0% | 25% | 50% | 75% |
| LRS 386 | 159 | 197 | 235 | 275 |
| LRS 387 | 143 | 188 | 200 | 259 |
| LRS 354 | 140 | 185 | 200 | 240 |
| LRS 431 | 148 | 202 | 237 | 265 |
| LRS 432 | 145 | 202 | 226 | 251 |
| LRS 474 | 165 | 206 | 225 | 253 |
| LRS 391 | 173 | 199 | 232 | 246 |
| LRS 359 | 161 | 191 | 222 | 269 |
| LRS 487 | 123 | 166 | 190 | 213 |
| LRS 488 | 105 | 143 | 165 | 195 |
| LRS 490 | 144 | 183 | 229 | 270 |
| LRS 491 | 130 | 165 | 215 | 256 |
| LRS 494 | 146 | 190 | 225 | 258 |
| 5N | 155 | 196 | 225 | 257 |

The applicant has finally conceived another family of alloys that shows, under the conditions referred to in the ISO DIS 8654:2017 standard, a color substantially compatible with the 5N alloy color standard and that are tarnishing resistant. This alloy family comprises in its more general formulation Gold: in the amount comprised between 780‰, more preferably 790‰, and 900‰ in weight;

Copper: in the amount comprised between 85‰ and 170‰ in weight;

Palladium, in the amount comprised between 4‰ and 17‰ in weight;

wherein the sum of the amounts of Gold and Copper is at least equal to 958‰ in weight.

More in detail, in the above mentioned family, the sum of the amounts of Gold, Copper and Palladium is at least equal to 963‰ in weight. The above mentioned family shows a color substantially compatible with the 5N alloy color according to the ISO DIS 8654:2017 standard and shows a resistance to tarnishing, specifically in environments containing Thioacetamide, in 50 g/L NaCl solution and in air, better than the one assumed by the alloy in the 5N formulation, in particular with respect to the reference sample according to the ISO 5N standard used as reference.

To this specific family belong for example specific embodiments of Gold alloy whose composition is substantially similar, for example and non-limiting thereto, to:

LRS 494: Au in the amount equal to 791‰ in weight, Cu in the amount equal to 167‰ in weight, Ag in the amount equal to 32‰ in weight, Pd in the amount equal to 5‰ in weight and Pt in the amount equal to 5‰ in weight.

The applicant has noted that from the general formulation of the above mentioned family, can be derived a first subfamily wherein the sum of the amounts of Gold, Copper and Palladium is at least equal to 980‰ in weight and Palladium is comprised in the amount comprised between 8‰, more preferably 10‰, and 17‰, more preferably 15‰ in weight. This formulation, in particular when the amount of Gold exceeds per itself the 800‰ in weight, permits to optimize the behavior of the so obtained alloy in terms of color variation in environments containing Thioacetamide.

The applicant has in particular noted the existence, in the first subfamily of alloys, of ternary alloys, wherein Gold is contained in the amount comprised between 873‰ and 902‰ in weight. Preferred and non-limiting embodiments are in this case composed by:

LRS 487: Au in the amount equal to 875‰ in weight, Cu in the amount equal to 115‰ in weight, Pd in the amount equal to 10‰ in weight; and LRS 488: Au in the amount equal to 900‰ in weight, Cu in the amount equal to 85‰ in weight, Pd in the amount equal to 15‰ in weight.

In both the specific embodiments, the sum of the amounts of Au, Cu and Pd in weight is substantially, in particular punctually, equal to 1000‰.

In the first subfamily it has been noted a color variation ΔE (L*, a*, b*) within the 24 h in an environment containing Thioacetamide according to the ISO DIS 8654:2017 standard lower than 3.8, preferably lower than 2.

The applicant has also noted a second subfamily of alloys, belonging anyway to the above mentioned main family, wherein the alloy is a quaternary alloy comprising indium in the amount comprised between 13‰ and 22‰ in weight, and more precisely in the amount comprised between 15‰ and 20‰.

This second subfamily shows Gold alloys whose color variation ΔE (L*, a*, b*) within the 24 h in an environment containing Thioacetamide according to the ISO DIS 8654:2017 standard is lower than 3.5. This second subfamily of alloys, is an subfamily of alloys whose color variation in a 50 g/L NaCl solution at 35° C. after 72 h is kept equal or lower than 2.4, and more preferably lower than 2.3. Within 24 h, the color variation ΔE (L*, a*, b*) in a 50 g/L NaCl solution at 35° C. is lower than 1.75 and more preferably lower than 1.5. To this second subfamily belong alloys in the following preferred and non-limiting embodiments:

LRS 490: Au in the amount equal to 800‰ in weight, Cu in the amount equal to 170‰ in weight, Pd in the amount equal to 10‰ in weight; In in the amount equal to 20‰ in weight; and LRS 491: Au in the amount equal to 833‰ in weight, Cu in the amount equal to 137‰ in weight, Pd in the amount equal to 15‰ in weight and In in the amount equal to 15‰ in weight.

In the two specific formulations it has been noted that the increase of the Gold title permits a significant improvement of the performances of the LRS 491 alloy with respect to the LRS490 alloy in terms of resistance to color variation in an environment containing 50 g/L NaCl solution: in fact, after 72 hours of exposure, the LRS 491 alloy shows a color variation ΔE (L*, a*, b*) equal to 1.71 whereas the LRS 490 shows a color variation ΔE (L*, a*, b*) equal to 2.21. The improvement in terms of resistance to color variation that the LRS 491 alloy with higher Gold title shows with respect to the LRS 490 alloy with lower Gold title is more significant as the time of exposure to NaCl is higher.

In the second subfamily of alloys the increase of the Gold title is efficient furthermore in the reduction of the trend to the color variation in an environment containing Thioacetamide. In fact, after 48 hours, the LRS 491 alloy shows a color variation ΔE (L*, a*, b*) equal to 3.21 whereas under the same conditions the LRS 490 alloy shows a color variation ΔE (L*, a*, b*) equal to 4.20.

In relation to the LRS 494 alloy, this alloy belongs to a third alloy subfamily which comprises Gold in the amount comprised between 790‰ and 793‰ in weight and Silver in the amount higher or equal to 32‰ in weight. In this third subfamily, in particular, there is Platinum in the amount higher or equal to 4‰ in weight, and Copper in the amount higher than 165‰ in weight.

The following table shows a resuming representation for the above mentioned embodiments:

| ALLOY NAME | Au ‰ | Cu ‰ | Ag ‰ | Fe ‰ | Pd ‰ | In ‰ | Pt ‰ |
|---|---|---|---|---|---|---|---|
| LRS 487 | 875 | 115 | | | 10 | | |
| LRS 488 | 900 | 85 | | | 15 | | |
| LRS 490 | 800 | 170 | | | 10 | 20 | |
| LRS 491 | 833 | 137 | | | 15 | 15 | |
| LRS 494 | 791 | 167 | 32 | | 5 | | 5 |

The following table shows the color variation assumed by the mentioned alloys in an environment containing Thioacetamide.

| ΔE (L*, a*, b*) | 0 h | 2 h | 4 h | 24 h | 48 h |
|---|---|---|---|---|---|
| 5N | 0 | 0.71 | 1.32 | 3.60 | 4.42 |
| LRS 487 | 0 | 0.34 | 0.80 | 2.42 | 2.69 |
| LRS 488 | 0 | 0.46 | 0.92 | 2.13 | 2.54 |
| LRS 490 | 0 | 0.17 | 0.31 | 3.49 | 4.20 |
| LRS 491 | 0 | 0.30 | 0.82 | 2.32 | 3.21 |
| LRS 494 | 0 | 0.58 | 0.97 | 2.84 | 3.98 |

The following table shows the color variation assumed by the mentioned alloys in an environment containing 50 g/L NaCl solution, thermostated at 35° C.:

| ΔE (L*, a*, b*) | 0 h | 2 h | 4 h | 24 h | 72 h |
|---|---|---|---|---|---|
| 5N | 0 | 0.86 | 1.33 | 2.33 | 2.79 |
| LRS 487 | 0 | 0.47 | 0.72 | 1.30 | 1.68 |
| LRS 488 | 0 | 0.55 | 0.70 | 1.39 | 1.65 |
| LRS 490 | 0 | 0.45 | 0.68 | 1.44 | 2.21 |
| LRS 491 | 0 | 0.40 | 0.75 | 1.19 | 1.71 |
| LRS 494 | 0 | 0.66 | 1.10 | 2.08 | 2.39 |

The alloys according to the concepts herein are homogeneous Gold alloys, free from second phases, and in particular free from carbides and/or oxides and/or are crystalline alloys, in particular 100‰ crystalline. This permits to have a high strength and quality and surface uniformity. As "free from secondary phases" or "free from second phases" is intended an alloy free from elements that can generate them, in particular in a process of melting and subsequent solidification without other thermal treatments; second phases that create in the liquid phase and remain downstream of the alloy solidification, are harmful second phases, for example carbides and/or oxides that during the polishing step are visible at naked eye on the surface of the polished item, and that then prevent to obtain items with high surface quality, compatible with the needs required in the high jewelry field.

In the here described process of production of the Gold alloy, it is possible to expose the alloy to thermal treatment processes, able to give it a hardening, so that due to precipitation can be present subtle precipitates, results of said thermal treatment; in this case these are precipitates that prevent from the movement of displacement by increasing the mechanical properties in the material, and withstand the incidence of deformations in the items realized with the present alloys. The concepts herein encompass a jewelry item, comprising a Gold alloy according to the previously described characteristics. Although this jewelry item can have the most various shapes and characteristics, in particular it comprises a jewel, for example and non-limiting thereto, a bracelet, also chaton bracelet, a collier, earrings, rings or a watch or a watch bracelet or a movement or part of a mechanical movement for watches. In particular, said watch or mechanical movement for watches are configured for being respectively worn or installed in wristwatches. With the use of the Gold alloys embodying the concepts herein, these jewelry items have a color defined as "red" according to 5N standard, sufficiently stable also for use in particularly aggressive environments, such as skin in case of heavy perspiration and the marine environment (the latter being an environment where typically wedding bands and/or diving watches with for example portions of Gold bracelet or case are however typically worn by the user), absence of components likely to cause allergies, and sufficient hardness.

Finally, it is clear that the concepts herein may be subject to modifications, additions or variants, which are obvious to an expert in the art, without thereby falling outside the scope of protection provided by the attached claims.

The invention claimed is:

1. A Gold alloy for jewelry, comprising:

Gold: in the amount comprised between 780‰ and 840‰ in weight;

Copper: in the amount comprised between 125‰ and 167‰ in weight;

Silver: in the amount comprised between 15‰ and 54‰ in weight;

Platinum or Palladium, wherein the content of Palladium or Platinum is such that the assembly of Gold, Copper, Silver and Platinum or Gold, Copper, Silver and Palladium reaches 1000‰ in weight of the alloy;

and wherein the so composed Gold alloy shows, under the conditions referred to in the ISO DIS 8654:2017 standard, a color compatible with the standard of color of the 5N alloys.

2. A Gold alloy for jewelry according to claim 1, comprising Palladium in the amount comprised between 4‰ and 17‰, said Gold alloy being configured for resisting the color variation and/or tarnishing and undergoing in an environment containing Thioacetamide, in particular in an environment containing Thioacetamide according to the UNI EN ISO 4538:1998 standard, a color variation ΔE (L*, a*, b*) within the 24 h lower than 3.5, or lower than 3.2 or lower than 3.

3. A Gold allow for jewelry according to claim 2, wherein Palladium is present in the amount comprised between 4‰ and 16‰ in weight.

4. A Gold alloy for jewelry according to claim 3, wherein Palladium is present in the amount comprised between 5‰ and 15‰ in weight.

5. A Gold alloy for jewelry according to claim 1, wherein Silver is contained in the amount comprised between 15‰ and 37‰ in weight, and wherein the alloy is a quaternary Iron-free alloy.

6. A Gold alloy for jewelry according to claim 5, wherein Gold is present in the amount comprised in the interval 790‰-800‰ and wherein Copper is present in the amount comprised between 154‰ and 167‰ in combination with Silver in the amount comprised between 23‰ and 37‰ and with alternatively:

Palladium in the amount comprised between 9‰ and 11‰;

Platinum in the amount comprised between 4‰ and 6‰.

7. A Gold alloy for jewelry according to claim 5, wherein Silver is present in the amount comprised between 15‰ and 35‰ in weight.

8. A Gold alloy for jewelry according to claim 1, comprising Gold in the amount comprised between 790‰ and 792‰, Copper in the amount comprised between 165‰ and 167‰, Silver in the amount comprised between 32‰ and 40‰, Platinum between 4‰ and 6‰; the Gold alloy being free from Palladium.

9. A Gold alloy for jewelry according to claim 5, wherein Gold is present in the amount comprised in the interval 810‰-835‰ and wherein Copper is present in the amount comprised between 128‰ and 154‰, in combination with Silver in the amount comprised between 18‰ and 35‰ and with Palladium in the amount comprised between 5‰ and 15‰, and wherein the color variation ΔE (L*, a*, b*) within the 24 h in said environment containing Thioacetamide according to the ISO DIS 8654:2017 standard is lower than 3.8.

10. A Gold alloy for jewelry according to claim 9, wherein Copper is present in the amount comprised between 129‰ and 153‰ in weight.

11. A Gold alloy for jewelry according to claim 1, the Gold alloy being quaternary or quinary.

12. A method of production of a Gold alloy for jewelry, comprising:

a) a step of mixing a mixture of elements according to claim 1, b) a step of introduction of the mixture in a melting pot, and a subsequent melting through heating until melting.

13. The method according to claim 12, wherein said melting is a continuous melting, wherein the melted material is casted in a mold realized in graphite and wherein said mixture is a mixture of materials with anti-gripping properties on surfaces in graphite, in particular at least free from Vanadium.

14. The method according to claim 12, wherein said melting is a continuous or discontinuous melting, comprising a casting step wherein the melted material is casted in a die realized in graphite or in a bracket in graphite and wherein said mixture is a mixture of materials with properties chemically without affinity to surfaces in graphite.

15. The method according to claim 14, wherein after the continuous or discontinuous melting said alloy is subject to a cooling step followed by one or more hot or cold plastic deformation steps and one or more thermal treatments.

16. The method according to claim 12, wherein during said melting, the melting pot is subject to a gas controlled atmosphere and in particular is subject, at least temporarily, to vacuum condition.

17. A Gold alloy for jewelry according to claim 1, wherein Gold is present in the amount comprised between 790‰ and 840‰ in weight.

18. A Gold alloy for jewelry, comprising:

Gold: in the amount comprised between 790‰ and 792‰ in weight;

Copper: in the amount comprised between 165‰ and 167‰ in weight;

Silver: in the amount comprised between 32‰ and 40‰ in weight;

Platinum: in the amount comprised between 4‰ and 6‰ in weight, wherein the content of Platinum is such that the assembly of Gold, Copper, Silver and Platinum reaches at least 980‰ in weight of the alloy;

the Gold alloy showing, under the conditions referred to in the ISO DIS 8654:2017 standard, a color compatible with the standard of color of the 5N alloys;

the Gold alloy being free from Iron.

19. A Gold alloy for jewelry, comprising:

Gold: in the amount comprised between 780‰, and 840‰ in weight;

Copper: in the amount comprised between 125‰ and 167‰ in weight;

Silver: in the amount comprised between 15‰ and 54‰ in weight;

Platinum or Palladium, wherein the content of Palladium or Platinum is such that the assembly of Gold, Copper, Silver and Platinum or Gold, Copper, Silver and Palladium reaches at least 980‰ in weight of the alloy;

and wherein the so composed Gold alloy shows, under the conditions referred to in the ISO DIS 8654:2017 standard, a color compatible with the standard of color of the 5N alloys;

the Gold alloy being free from chemical elements causing generation of carbides and/or oxides, the Gold alloy being free from Nickel, Cobalt, Arsenic and Cadmium.

20. A Gold alloy for jewelry according to claim 19, wherein Gold is present in the amount comprised between 790‰ and 840‰ in weight.

21. A Gold alloy for jewelry according to claim 19, characterized by the absence of chemical elements susceptible to cause the generation of carbides and/or oxides, optionally characterized by the absence of Vanadium, Magnesium, Indium, Silicon, Tin, Titanium, Tungsten, Molybdenum, Niobium, Tantalum, Zirconium, Yttrium, Rhenium, Germanium and/or being free from secondary phases, and/or free from Silicon and/or in that it is crystalline.

* * * * *